US009132314B1

(12) United States Patent
Giannelli et al.

(10) Patent No.: US 9,132,314 B1
(45) Date of Patent: Sep. 15, 2015

(54) EXERCISE APPARATUS

(71) Applicant: Cybex International, Inc., Medway, MA (US)

(72) Inventors: Raymond Giannelli, Franklin, MA (US); Mark Buontempo, Millville, MA (US)

(73) Assignee: Cybex International, Inc., Medway, MA (US)

( * ) Notice: Subject to any disclaimer, the term of this patent is extended or adjusted under 35 U.S.C. 154(b) by 0 days.

(21) Appl. No.: 14/712,187

(22) Filed: May 14, 2015

Related U.S. Application Data

(63) Continuation of application No. PCT/US2014/055124, filed on Sep. 11, 2014.

(60) Provisional application No. 61/876,495, filed on Sep. 11, 2013.

(51) Int. Cl.

| | |
|---|---|
| ***A63B 22/00*** | (2006.01) |
| ***A63B 21/00*** | (2006.01) |
| ***A63B 22/06*** | (2006.01) |
| ***A63B 23/04*** | (2006.01) |
| ***A63B 24/00*** | (2006.01) |

(52) U.S. Cl.
CPC ..... *A63B 22/0015* (2013.01); *A63B 21/00069* (2013.01); *A63B 21/1446* (2013.01); *A63B 21/1465* (2013.01); *A63B 21/1496* (2013.01); *A63B 22/0605* (2013.01); *A63B 22/0664* (2013.01); *A63B 23/0476* (2013.01); *A63B 24/0062* (2013.01); *A63B 2022/0092* (2013.01)

(58) Field of Classification Search
CPC ..... A63B 22/0015; A63B 22/0605; A63B 22/0664; A63B 21/0069; A63B 21/1446; A63B 21/1465; A63B 22/1496; A63B 23/0476; A63B 24/0062; A63B 2022/0092
See application file for complete search history.

(56) References Cited

U.S. PATENT DOCUMENTS

| | | | | |
|---|---|---|---|---|
| 4,842,266 A | | 6/1989 | Sweeney, Sr. et al. | |
| 5,004,224 A | * | 4/1991 | Wang | 482/53 |
| 5,039,088 A | * | 8/1991 | Shifferaw | 482/51 |

(Continued)

FOREIGN PATENT DOCUMENTS

| | | |
|---|---|---|
| JP | 3183390 | 5/2013 |
| KR | 10-0834880 | 5/2008 |

OTHER PUBLICATIONS

Int'l Search Report and Written Opinion dated Feb. 4, 2015 in Int'l. Appln. No. PCT/US2014/055124.

*Primary Examiner* — Glenn Richman
(74) *Attorney, Agent, or Firm* — Novak Druce Connolly Bove + Quigg LLP

(57) ABSTRACT

An exercise apparatus comprising: a foot support, a user interface that includes a visual display, the foot support being movable by the user on the frame back and forth through any one of a plurality of complete, reproducible and different arc segments of a master arcuate path, the foot support being interconnected to a selection device that enables the user to select any one of the plurality of arc segments, one or more detectors adapted to detect one or more of force, energy or power exerted by the user over time on the foot support or distance or velocity of travel of the foot support or resistance assembly during the course of the user's performance of all or a portion of an exercise cycle, the visual display displaying a visually recognizable format of one or more of the force, energy, power, distance, time or velocity.

22 Claims, 20 Drawing Sheets

(56) References Cited

U.S. PATENT DOCUMENTS

| | | | | |
|---|---|---|---|---|
| 5,114,388 | A | 5/1992 | Trulaske | |
| 5,254,066 | A | 10/1993 | Brown et al. | |
| 5,496,235 | A * | 3/1996 | Stevens | 482/51 |
| 8,025,609 | B2 | 9/2011 | Giannelli et al. | |
| 8,235,873 | B1 * | 8/2012 | Stearns et al. | 482/51 |
| 2006/0116247 | A1 * | 6/2006 | Dyer et al. | 482/52 |
| 2012/0322621 | A1 | 12/2012 | Bingham, Jr. et al. | |

* cited by examiner

EXERCISE APPARATUS

CROSS REFERENCE TO RELATED APPLICATIONS

This application is a continuation of and claims the benefit of priority to PCT/US14/055124 filed Sep. 11, 2014 which in turn claims the benefit of priority to U.S. provisional patent application Ser. No. 61/876,495 filed Sep. 11, 2013. The disclosures of all of the foregoing are incorporated by reference in their entirety as if fully set forth herein.

This application incorporates by reference in their entirety as if fully set forth herein the disclosures of all of the following: U.S. Pat. No. 8,025,609, U.S. Pat. No. 7,278,955, U.S. Pat. No. 8,062,185, U.S. Pat. No. 8,057,363, U.S. Pat. No. 8,454,478, U.S. Application Publication No. 20090176625 and U.S. Pat. No. 8,708,872.

FIELD OF THE INVENTION

The present invention relates to physical exercise machines and more particularly to an exercise apparatus that enables users to perform simulated walking, running or other back and forth leg movement exercise that is resisted by a resistance mechanism.

BACKGROUND OF THE INVENTION

Exercise machines for simulating walking or running are known and used for directing the movement of a user's legs and feet in a variety of repetitive paths of travel. The user typically performs an exercise using such a walking or running machine for an extended period of time such as one to 30 minutes without interruption and without stopping to perform a different exercise using a different machine such as a user might perform in a circuit protocol of exercise. The machines typically include an electrically powered mechanism that the user can activate to adjust some aspect of the machine such as degree of resistance. Running or walking simulation machines commonly referred to as elliptical path machines have been designed to pivot the foot pedals on which the user's feet reside guiding the pedals and the user's feet to travel in an elliptical or arcuate path. The degree of resistance to performance of the exercise in such prior art machines typically varies linearly with the degree of force or speed exerted by the user to a moving mechanical component of the apparatus. The path of travel of the foot pedal in such prior machines is not adjustable other than to change the shape of the ellipse. The foot travels along a different path from back to front than from front to back in such elliptical machines.

SUMMARY OF THE INVENTION

In accordance with the invention there is provided an exercise apparatus comprising:

a foot support supported by a linkage system on a frame having a laterally forward end and a laterally rearward end, the foot support being supported on the frame by the linkage system for reciprocal movement along a master arcuate path of travel having a furthest forward to furthest rearward position, the foot support being arranged on the frame in a disposition for receiving a user's foot to support the user in a standing upright position, the foot support being interconnected to a non-linearly force dependent resistance mechanism, the interconnection of the foot support and the non-linearly force dependent resistance mechanism comprising an adjustment device that is actuatable by the user to selectively adjust positioning of the force resistance mechanism in or to any one of a plurality of predetermined fixed mechanical positions relative to the foot support, wherein actuation of the adjustment device to position the non-linearly force dependent resistance mechanism in or to one of the predetermined fixed mechanical positions of the non-linearly dependent force resistance mechanism limits travel of the foot support to a selectable segment of the master arcuate path of travel having a forwardmost segment position and rearwardmost segment position that are defined by and peculiar to the fixed position of the non-linearly dependent resistance mechanism, the foot support being mechanically movable along any selectable segment by a user standing in an upright position and exerting a laterally forward to rearward directed force of selected degree on the foot support with the foot of the user, the non-linearly force dependent resistance mechanism being adapted to mechanically vary resistance to movement of the foot support to a degree that varies non-linearly with the selected degree of speed, velocity, force, work or power exerted by the user on the foot support or the resistance assembly.

The term "non-linear" or "non-linearly" is meant to encompass and include an exponential or geometric relationship between the degree of increase in resistance and the degree of increase in velocity or speed of movement of a mechanical component of the apparatus as a result of force exerted by the user on the mechanical component such as the translational movement of a foot pedal or the rotational movement of a fan wheel. Also, as discussed below, the term "force" is intended to encompass and include user exerted power, energy or work which are all directly proportional to force. As shown generically in FIG. 3B, in embodiments described herein where the resistance assembly includes a fan such as wheel 200, the degree of resistance or opposing force OF that the finned or fan wheel 200 exerts in response to a user's input of force, work or power increases non-linearly 310, FIG. 3B, with increasing speed or rate of rotation SR of the wheel 200. Typically the degree of such resistance increases exponentially or geometrically and more specifically by a cube or cubed factor of or with the degree of speed of rotation SR of a fan wheel. The degree of increase in resistance may vary in another or different mathematically determinable non-linear manner with respect to a translational, sliding, arcuate or pivoting movement of another or different mechanical component of the apparatus such as a lever or tie bar or the like. Other resistance mechanisms other than a finned 210 wheel 200 such as an Eddy current controlled brake mechanism with programmable controls that can be employed that increase, decrease or vary in degree of resistance relative to the force F exerted by the user in a non-linear, geometric or exponential manner or relationship.

In such an apparatus the non-linearly force dependent resistance mechanism preferably includes a mechanical member that mechanically moves in response to force exerted by the user on the foot support, the movement of the mechanical member mechanically generating a resistance that varies non-linearly with the speed, velocity, force, work or power exerted by the user on the foot support or the resistance assembly.

The non-linearly force dependent resistance mechanism preferably mechanically varies resistance to movement of the foot support to a degree that varies either exponentially or geometrically with the selected speed, velocity, force, work or power exerted by the user on the foot support or the resistance assembly.

The foot support is preferably adapted to move upwardly and downwardly on movement of the foot support along a segment, the user exerting a force directed in an upward, downward direction during movement of the foot support along a selected segment.

Each segment preferably has forwardmost upward segment position and a rearwardmost downward segment position that define a complete cycle, each segment having a different forwardmost upward segment position and a different rearwardmost downward segment position.

Most preferably the non-linearly force dependent resistance mechanism comprises a wheel having a drivably rotatable axle interconnected to one or more blades that forcibly engage against air on rotation of the axle. The axle of the wheel is typically fixedly interconnected to a crank arm that is interconnected to the foot support such that forward and backward movement of the foot support turns the crank arm.

The foot support is typically mechanically interconnected to the non-linearly force dependent resistance mechanism, the mechanical interconnection of the foot support and the non-linearly force dependent resistance mechanism comprising a mechanical adjustment device that is manually actuatable by the user to selectively adjust positioning of the non-linearly force dependent resistance mechanism in or to any one of a plurality of fixed positions relative to the foot support, wherein manual actuation of the mechanical adjustment device to position the non-linearly force dependent resistance mechanism in or to one of the fixed positions of the mechanical resistance mechanism limits travel of the foot support to a selectable segment of the master arcuate path of travel having a forwardmost segment position and rearwardmost segment position that are defined by and peculiar to the fixed position of the force resistance mechanism.

The apparatus can further comprise:

a vibration generation device that is interconnected to a support component of the apparatus such that activation of the vibration generation device transmits vibration force or energy to the user, a sound generator that generates audio signals that are converted to sound that is audible to the user while performing the selected exercise using the apparatus, a controller interconnected to the sound generator and the vibration generation device, the controller including instructions that activate the vibration generation to generate and transmit a selected degree of vibration force or energy to the one or more interconnected transmission components according a predetermined algorithm, the controller receiving the audio signals for input of one or more components of the audio signals to the predetermined algorithm, the predetermined algorithm including instructions that utilize the one or more components of the received audio signals as variables in a program that instructs the vibration generation device to activate and transmit vibration force or energy to the one or more transmission components of the apparatus to a controlled degree, intensity, amplitude, duration and frequency that varies according to the one or more components of the received audio signals.

In another aspect of the invention there is provided a method of varying the degree of resistance in a non-linear relationship to a the degree of force exerted by a user in performance of an exercise on an exercise apparatus comprised of a foot support supported by a linkage system on a frame having a laterally forward end and a laterally rearward end, the foot support being supported on the frame by the linkage system for reciprocal movement along a master arcuate path of travel having a furthest forward to furthest rearward position, the foot support being supported on the frame for receiving a user's foot to support the user in a standing upright position, the method comprising:

interconnecting the foot support to a non-linearly force dependent resistance mechanism, interconnecting the foot support and the non-linearly force dependent resistance mechanism via an adjustment device that is actuatable by the user to selectively adjust positioning of the force resistance mechanism in or to any one of a plurality of fixed positions relative to the foot support, actuating the adjustment device to position the non-linearly force dependent resistance mechanism in or to one of the fixed positions of the non-linearly dependent force resistance mechanism, adapting the interconnection of the foot support and the non-linearly force dependent resistance mechanism to limit travel of the foot support to selectable segments of the master arcuate path of travel each having a forwardmost segment position and rearwardmost segment position that are defined by and peculiar to the fixed position of the non-linearly dependent resistance mechanism, disposing a user in a standing upright position on the foot support and forcibly exerting a selectable degree of laterally forward to rearward directed force on the foot support with the foot of the user, adapting the non-linearly force dependent resistance mechanism to mechanically vary resistance to movement of the foot support to a degree that varies non-linearly with the selected degree of speed, velocity, force, work or power exerted by the user on the foot support or the resistance assembly.

Such a method typically further comprises adapting the non-linearly force dependent resistance mechanism to generate resistance in response to movement of a mechanical member wherein the resistance varies non-linearly with the degree of speed, velocity, force, work or power exerted by the user on the foot support or the resistance assembly.

The non-linearly force dependent resistance mechanism preferably mechanically varies resistance to movement of the foot support to a degree that varies either exponentially or geometrically with the selected degree of speed, velocity, force, work or power exerted by the user on the foot support or the resistance assembly.

Such a method can further comprise adapting the foot support to move upwardly and downwardly on movement of the foot support along a segment, the user exerting a force directed in an upward, downward direction during movement of the foot support along a selected segment.

Such a method can further comprise adapting the foot support to be supported such that each segment has forwardmost upward segment position and a rearwardmost downward segment position that define a complete cycle, each segment having a different forwardmost upward segment position and a different rearwardmost downward segment position.

Such a method can further comprise adapting the non-linearly force dependent resistance mechanism to comprise a wheel having a drivably rotatable axle interconnected to one or more blades that forcibly engage against air on rotation of the axle.

Such a method can further comprise adapting the axle of the wheel to be fixedly interconnected to a crank arm that is interconnected to the foot support such that forward and backward movement of the foot support turns the crank arm.

In another aspect of the invention there is provided an exercise apparatus comprising:

a foot support supported by a linkage system on a frame having a laterally forward end and a laterally rearward end, the foot support being supported on the frame by the linkage system for reciprocal movement along a master arcuate path of travel having a furthest forward to furthest rearward position, the foot support being arranged on the frame in a disposition for receiving a user's foot to support the user in a standing upright position, the foot support being interconnected to a non-linearly force dependent resistance mechanism, the foot support being mechanically movable along the master arcuate path of travel by a user standing in an upright position and exerting a laterally forward to rearward directed force of selected degree on the foot support with the foot of the user, the non-linearly force dependent resistance mechanism being adapted to mechanically vary resistance to movement of the foot support to a degree that varies non-linearly with the selected degree of speed, velocity, force, work or power exerted by the user on the foot support or the resistance assembly.

In such an apparatus the non-linearly force dependent resistance mechanism typically includes a mechanical member that mechanically moves in response to force exerted by the user on the foot support, the movement of the mechanical member mechanically generating a resistance that varies non-linearly with the degree of speed, velocity, force, work or power exerted by the user on the foot support or the resistance assembly.

The non-linearly force dependent resistance mechanism preferably mechanically varies resistance to movement of the foot support to a degree that varies either exponentially or geometrically with the selected degree of speed, velocity, force, work or power exerted by the user on the foot support or the resistance assembly.

The foot support is preferably adapted to move upwardly and downwardly on movement of the foot support along a segment, the user exerting a force directed in an upward, downward direction during movement of the foot support along a selected segment.

The non-linearly force dependent resistance mechanism preferably comprises a wheel having a drivably rotatable axle interconnected to one or more blades that forcibly engage against air on rotation of the axle. The axle of the wheel is preferably fixedly interconnected to a crank arm that is interconnected to the foot support such that forward and backward movement of the foot support turns the crank arm.

Each segment typically has forwardmost upward segment position and a rearwardmost downward segment position that define a complete cycle, each segment having a different forwardmost upward segment position and a different rearwardmost downward segment position.

In another aspect of the invention there is provided an exercise apparatus comprising:

a foot support suspended from above by a suspension assembly on a frame, the foot support being movable by the user on the frame back and forth between a rearwardmost downward position and a forwardmost upward position through any one of a plurality of complete, reproducible and different arc segments of a master arcuate path that is the same path from the rearwardmost downward position to the forwardmost upward position and back to the rearwardmost downward position, each different arc segment being individually selectable by the user, each said different arc segment being defined by movement of the foot support between a corresponding different forwardmost upward position and different rearwardmost downward position, each of said different arc segments having a different degree of incline corresponding to each different forwardmost upward and rearwardmost downward position of the foot support, wherein movement of the foot support between the rearwardmost downward position and the forwardmost upward position and back to the rearwardmost downward position defines a complete exercise cycle, a resistance assembly interconnected to the foot support, the resistance assembly being adapted to exert a resistance to movement of the foot support by the user that a resistance assembly interconnected to the foot support, the resistance assembly being adapted to exert a resistance to movement of the foot support by the user that varies non-linearly with the degree of speed, velocity, force, work or energy exerted by the user on the foot support or the resistance assembly, the foot support being adapted to support the user in an upright position with the user's foot disposed on the foot support, the foot support being interconnected to a selection device that enables the user to select any one of the plurality of arc segments.

In such an apparatus the selection device can be manually actuatable by the user to exert a selectable amount of manual force on the selection device that operates to selectively position the resistance assembly in one of a plurality of predetermined fixed mechanical positions according to the selectable amount of manual force exerted by the user on the selection device.

In such an apparatus the resistance assembly preferably comprises a fan interconnected to the foot support for rotation in response to back and forth movement of the foot support.

In another aspect of the invention there is provided an exercise apparatus comprising:

a foot support suspended from above by a suspension assembly on a frame and interconnected to a resistance assembly that exerts a resistance to movement of the foot support by a user, the foot support being adapted to support the user in an upright position with the user's foot disposed on the foot support, a user interface that includes a visual display readily visually observable and manually accessible by the user when the user's foot is disposed on the foot support, the foot support being movable by the user on the frame back and forth between a rearwardmost downward position and a forwardmost upward position through any one of a plurality of complete, reproducible and different arc segments of a master arcuate path that is the same path from the rearwardmost downward position to the forwardmost upward position and back to the rearwardmost downward position, each different arc segment being individually selectable by the user, each said different arc segment being defined by movement of the foot support between a corresponding different forwardmost upward position and different rearwardmost downward position, each of said different arc segments having a different degree of incline corresponding to each different forwardmost upward and rearwardmost downward position of the foot support, wherein movement of the foot support between the rearwardmost downward position and the forwardmost upward position and back to the rearwardmost downward position defines a complete exercise cycle, the foot support being interconnected to a selection device that enables the user to select any one of the plurality of arc segments, one or more detectors adapted to detect one or more of force, energy or power exerted by the user over time on the foot support or to detect distance or velocity of travel of the foot support or of the resistance assembly during the course of the user's performance of all or a portion of an exercise cycle, the one or more detectors sending signals that are indicative of one or more of the detected force, energy, power, time, distance or velocity to a processor, the processor receiving the signals from the one or more detectors and processing the signals according to a predetermined algorithm to generate a visually recognizable output format of one or more of said force, energy, power, time, distance, velocity or other result calculable from said signals, the processor being interconnected to and sending the processed signals to the visual display, the visual display being arranged and displaying the processed signals to the user in the visually recognizable output format in a location on the apparatus that is readily observable by the user.

In such an apparatus the foot support and the resistance assembly are typically interconnected by the selection device, the selection device being operable by the user to selectively position the resistance assembly in any one of a plurality of predetermined fixed mechanical positions that respectively correspond to a selectable one of the plurality of arc segments.

The selection device is preferably manually actuatable by the user to exert a selectable amount of manual force on the selection device that operates to selectively position the resistance assembly in a one of the plurality of predetermined fixed mechanical positions according to the selectable amount of manual force exerted by the user on the selection device.

The resistance assembly can exert a degree of resistance that increases non-linearly with the degree of increase of force, energy or velocity of travel exerted by the user on the foot support.

The resistance assembly can exert a degree of resistance that increases exponentially or geometrically with the degree of increase of force, energy or velocity of travel exerted by the user on the foot support.

The resistance assembly can comprise a rotatable fan or blade adapted to rotate in response to movement of the foot support such ambient air impinges on and resists rotation of the fan or blade.

In such an apparatus the user interface can include a start button manually actuatable by the user to initiate detection of movement of the foot support by the one or more detectors upon manual actuation of the start button by the user.

The user interface can include a stop button manually actuatable by the user to stop detection of movement of the foot support by the one or more detectors upon manual actuation of the stop button by the user.

The processor can include control instructions that instruct the processor to send processed signals to the visual display during a preselected interval of exercise time and to stop receiving signals from the detector or to stop sending the processed signals to the visual display on expiration of the preselected interval of exercise time, the user interface including an interval button interconnected to the processor that is manually actuatable by the user to input and send a signal to the processor that is indicative of the preselected interval of exercise time.

The control instructions can include instructions that define a preselected interval of rest time immediately subsequent to the preselected interval of exercise time, wherein during said preselected interval of the rest time the processor does not receive signals from the detector or does not send the processed signals to the visual display, the control instructions further including instructions that instruct the processor to repeat the preselected interval of exercise time and the preselected interval of rest time a preselected number of times following expiration of a first preselected interval of exercise time and a first preselected interval of rest time.

In another aspect of the invention there is provided a method of performing multiple different exercises in time sequential manner by an exerciser, the method comprising:

the exerciser's selecting at least first and second different exercise regimes that require exercise of different muscle groups, the exerciser's performing and completing a selected one of the first or second exercise regimes, substantially immediately after the step of performing and completing the selected one of the first or second exercise regimes, the exerciser's performing and completing the other of the first or second exercise regimes, wherein the first exercise regime comprises performing an exercise by the exerciser using an apparatus comprising:

a foot support suspended from above by a suspension assembly on a frame and interconnected to a resistance assembly that exerts a resistance to movement of the foot support by a user, the foot support being adapted to support the user in an upright position with the user's foot disposed on the foot support, a user interface that includes a visual display readily visually observable and manually accessible by the user when the user's foot is disposed on the foot support, the foot support being movable by the user on the frame back and forth through any one of a plurality of complete, reproducible and different arc segments of a master arcuate path defined by the suspension assembly, each different arc segment being individually selectable by the user, each said different arc segment being defined by movement of the foot support between a corresponding different forwardmost upward position and different rearwardmost downward position, each of said different arc segments having a different degree of incline corresponding to each different forwardmost upward and rearwardmost downward position of the foot support, wherein movement of the foot support between a rearwardmost downward position and a forwardmost upward position and back to the rearwardmost downward position defines a complete exercise cycle, the foot support being interconnected to a selection device that enables the user to select any one of the plurality of arc segments, one or more detectors adapted to detect one or more of force, energy or power exerted by the user over time on the foot support or to detect distance or velocity of travel of the foot support or of the resistance assembly during the course of the user's performance of all or a portion of an exercise cycle, the one or more detectors sending signals that are indicative of one or more of the detected force, energy, power, time, distance or velocity to a processor, the processor receiving the signals from the one or more detectors and processing the signals according to a predetermined algorithm to generate a visually recognizable output format of one or more of said force, energy, power, time, distance, velocity or other result calculable from said signals, the processor being interconnected to and sending the processed signals to the visual display, the visual display being arranged and displaying the processed signals to the user in the visually recognizable output format in a location on the apparatus that is readily observable by the user.

In another aspect of the invention there is provided an exercise apparatus comprising:

a foot support suspended from above by a suspension assembly on a frame and adapted to support a user in an upright position with the user's foot disposed on the foot support, the foot support being interconnected to a resistance assembly, a user interface that includes a visual display readily visually observable and manually accessible by the user when the user's foot is disposed on the foot support, the foot support being movable by the user on the frame back and forth through any one of a plurality of complete, reproducible and different arc segments of a master arcuate path defined by the suspension assembly, each different arc segment being individually selectable by actuation of a selection device that is interconnected to the foot pedal and is operable by the user to mechanically limit travel of the foot pedal to a selectable one of the plurality of arc segments, wherein the selection device is manually actuatable by the user to enable the user to exert a selectable amount of manual force on the selection device that operates to selectively limit travel of the foot pedal to a selectable one of the plurality of arc segments according to the selectable amount of manual force exerted by the user on the selection device, each said different arc segment being defined by movement of the foot support between a corresponding different forwardmost upward position and different rearwardmost downward position, each of said different arc segments having a different degree of incline corresponding to each different forwardmost upward and rearwardmost downward position of the foot support, wherein movement of the foot support between a rearwardmost downward position and a forwardmost upward position and back to the rearwardmost downward position defines a complete exercise cycle, one or more detectors adapted to detect one or more of force, energy or power exerted by the user over time on the foot support or to detect distance or velocity of travel of the foot support or of the resistance assembly during the course of the user's performance of all or a portion of an exercise cycle, the one or more detectors sending signals that are indicative of one or more of the detected force, energy, power, time, distance or velocity to a processor, the processor receiving the signals from the one or more detectors and processing the signals according to a predetermined algorithm to generate a visually recognizable output format of one or more of said force, energy, power, time, distance, velocity or other result calculable from said signals, the processor being interconnected to and sending the processed signals to the visual display, the visual display being arranged and displaying the processed signals to the user in the visually recognizable output format in a location on the apparatus that is readily observable by the user.

In such an apparatus the foot support and the resistance assembly are typically interconnected by the selection device, the selection device being operable by the user to selectively position the resistance assembly in any one of a plurality of predetermined fixed mechanical positions that respectively correspond to a selectable one of the plurality of arc segments.

In another aspect of the invention there is provided a method of performing multiple different exercises in time sequential manner by an exerciser, the method comprising:

the exerciser's selecting at least first and second different exercise regimes that require exercise of different muscle groups, the exerciser's performing and completing a selected one of the first or second exercise regimes, substantially immediately after the step of performing and completing the selected one of the first or second exercise regimes, the exerciser's performing and completing the other of the first or second exercise regimes, wherein the first exercise regime comprises performing an exercise by the exerciser using an apparatus as described immediately above.

In another aspect of the invention there is provided an exercise apparatus comprising:

a foot support suspended from above by a suspension assembly on a frame and interconnected to a resistance assembly that exerts a resistance to movement of the foot support by a user, the foot support being adapted to support the user in an upright position with the user's foot disposed on the foot support, a user interface that includes a visual display readily visually observable and manually accessible by the user when the user's foot is disposed on the foot support, the foot support being movable by the user on the frame back and forth through any one of a plurality of complete, reproducible and different arc segments of a master arcuate path defined by the suspension assembly, each different arc segment being individually selectable by the user, each said different arc segment being defined by movement of the foot support between a corresponding different forwardmost upward position and different rearwardmost downward position, each of said different arc segments having a different degree of incline corresponding to each different forwardmost upward and rearwardmost downward position of the foot support, wherein movement of the foot support between a rearwardmost downward position and a forwardmost upward position and back to the rearwardmost downward position defines a complete exercise cycle, the foot support being interconnected to a selection device that enables the user to select any one of the plurality of arc segments, one or more detectors adapted to detect one or more of force, energy or power exerted by the user over time on the foot support or to detect distance or velocity of travel of the foot support or of the resistance assembly during the course of the user's performance of all or a portion of an exercise cycle, the one or more detectors sending signals that are indicative of one or more of the detected force, energy, power, time, distance or velocity to a processor, the processor receiving the signals from the one or more detectors and processing the signals according to a predetermined algorithm to generate a visually recognizable output format of one or more of said force, energy, power, time, distance, velocity or other result calculable from said signals, the resistance assembly comprising a fan, the algorithm including instructions that receive and process an environment value indicative of at least one of air temperature and air pressure, the environment value being used by the instructions as a variable to generate the visually recognizable output format of said force, energy, power, time, distance, velocity or other result calculable from said signals, the processor being interconnected to and sending the processed signals to the visual display, the visual display being arranged and displaying the processed signals to the user in the visually recognizable output format in a location on the apparatus that is readily observable by the user.

In another aspect of the invention there is provided a method of performing multiple different exercises in time sequential manner by an exerciser, the method comprising:

the exerciser's selecting at least first and second different exercise regimes that require exercise of different muscle groups, the exerciser's performing and completing a selected one of the first or second exercise regimes, substantially immediately after the step of performing and completing the selected one of the first or second exercise regimes, the exerciser's performing and completing the other of the first or second exercise regimes, wherein the first exercise regime comprises performing an exercise by the exerciser using an apparatus according to claim 15.

BRIEF DESCRIPTION OF THE DRAWINGS

The above and further advantages of the invention may be better understood by referring to the following description in conjunction with the accompanying drawings in which.

DETAILED DESCRIPTION

Figure 1:
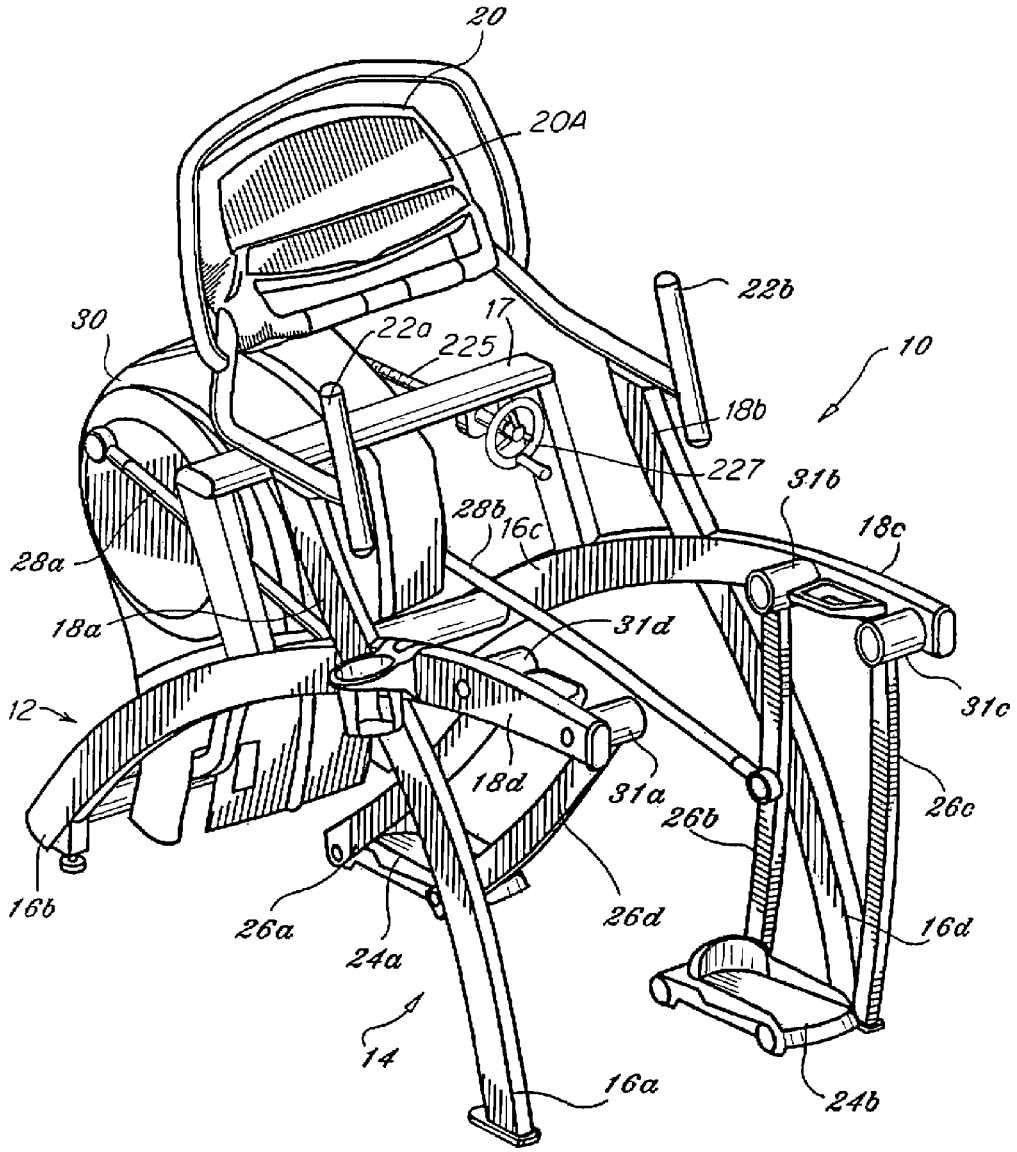
FIG. 1 is a rear perspective view of a device in accordance with the invention having a manual screw selection or adjustment device for selecting an arc segment.

FIGS. 1-13 illustrate various embodiments an arc segment selectable exercise apparatus 10 that can be used in conjunction with a user interface 20 and associated processor 500 and sensor(s) or detector(s) D, FIG. 14-21, in accordance with the invention to enable a user to perform a variety of circuit or interval exercise routines or regimes in accordance with another aspect of the invention. The processor 500 is typically mounted within the housing 20*h* of the user interface but can alternatively be mounted remotely from the interface 20 and apparatus communicating wirelessly or via cables or wires with the visual display components of the user interface. A "processor," as used herein, refers to electrical, electromechanical and electronic control apparati that can comprise a single box or multiple boxes (typically interconnected and communicating with each other) that contain(s) all of the separate electronic processing, memory and electrical or electronic signal generating components that are necessary or desirable for carrying out, creating, enabling and implementing the methods, functions and apparatuses described herein. Such electronic and electrical components include RAM, ROM and solid state or non-solid state memory devices, programs, algorithms, chips, chipsets, programs, processors, microprocessors, computers, PID controllers, voltage regulators, current regulators, circuit boards, motors, batteries and instructions for controlling any variable element discussed herein such as length of time, degree of electrical signal output and the like. For example a component of a processor, as that term is used herein, includes programs, data, algorithms, controllers and the like that perform functions such as storing and processing data, sending and receiving signals from sensors or detectors, or sending and receiving signals that instruct, and functions such as monitoring, alerting, initiating, executing or instructing an LCD or other visual display to display numbers, data or other information in a visually observable format by a human user.

FIGS. 14-21 illustrate a user interface component 20 of an apparatus according to the invention that serves to facilitate certain forms of cardiovascular training that have recently emerged: circuit training and interval training. Both workout techniques use a cycle of brief, high energy activity, followed by a rest period of similar length, as the fundamental building block for all workout routines. Interval training consists of a user or group of users repeatedly performing cycles of a single exercise, alternating between exercise and rest, while maintaining some form of timing scheme or plan. Circuit training consists of a user or group of users consecutively performing cycles of different exercises that each exercise different muscle groups, "circling" from one exercise station to the next while maintaining some form of timing scheme or plan. At any given step, different users with different body sizes and fitness levels will operate the same given device, making ease of use and speed of configuration important factors for any circuit training device.

Figure 10:
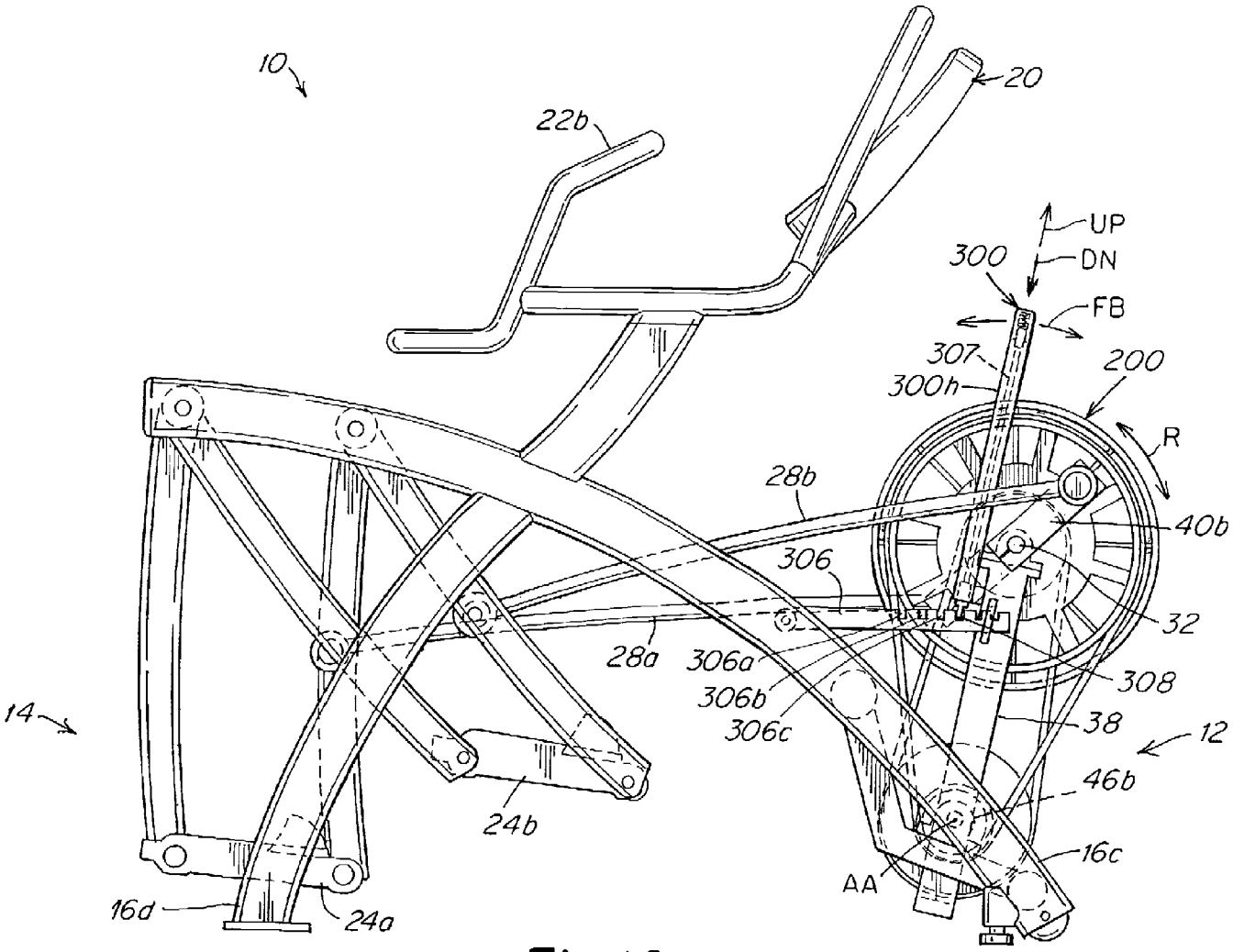
FIG. 10 is a right side view of the FIG. 9 apparatus.
Figure 11:
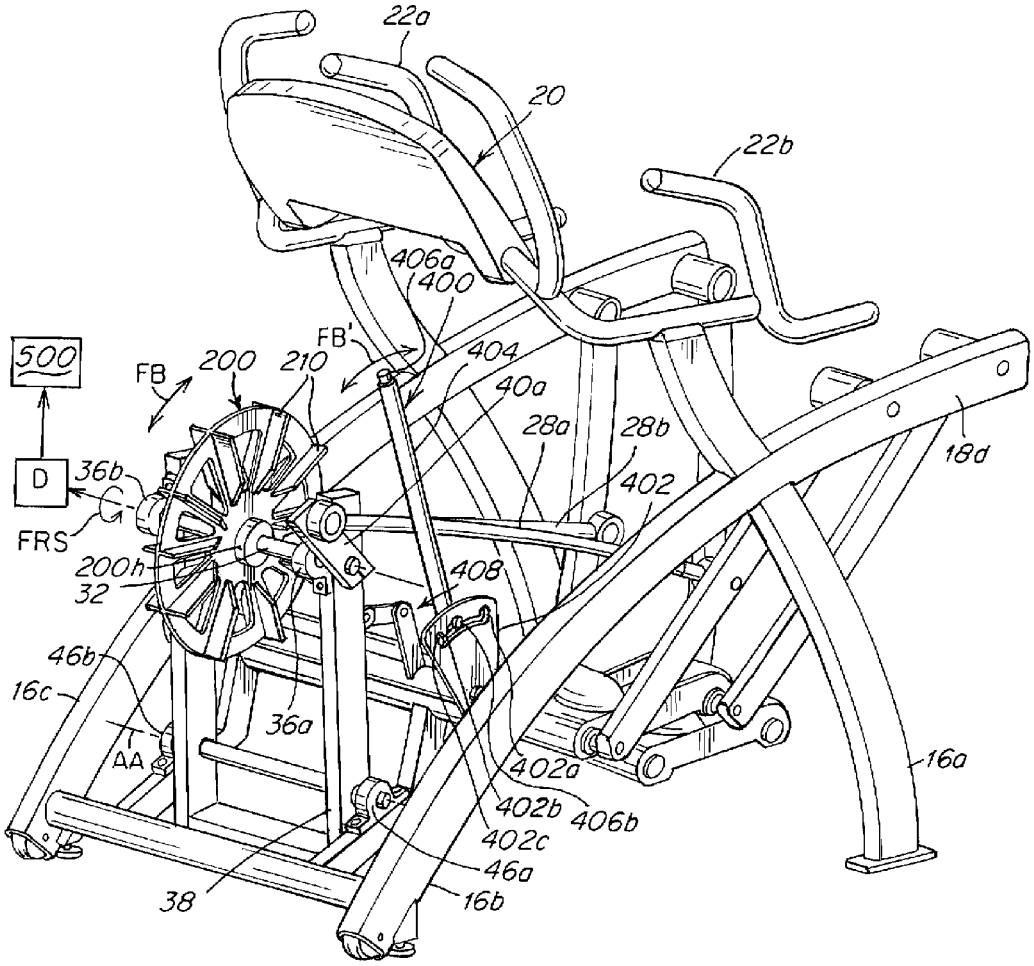
FIG. 11 is a left side perspective view of another embodiment of an apparatus according to the invention having a manually actuatable handle as the selection or adjustment device for selecting an arc segment.
Figure 12:
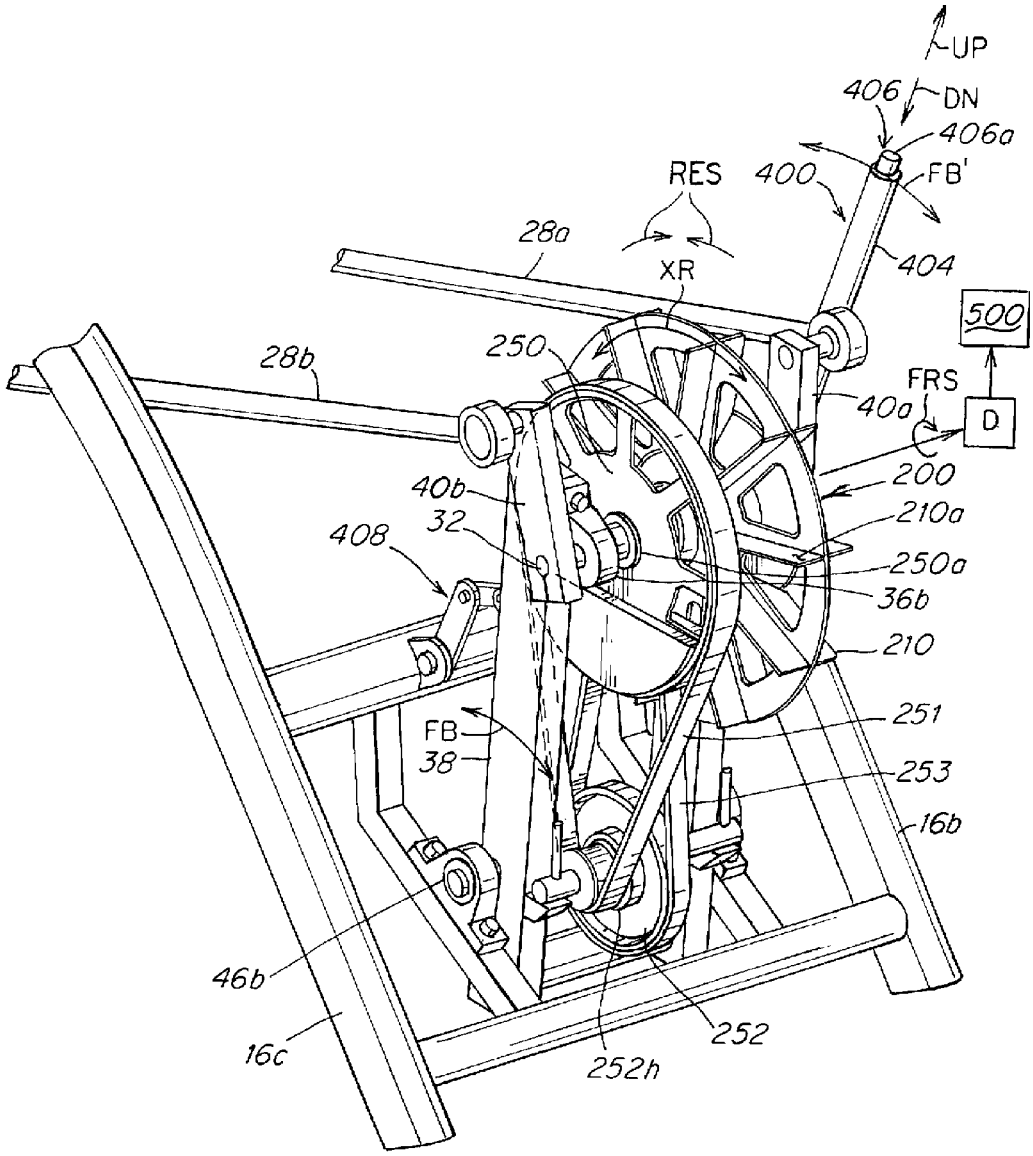
FIG. 12 is a right side enlarged view of the front end of the FIG. 11 apparatus showing additional components of the resistance assembly and selection device including rotation increasing pulleys and drive belts interconnected between the primary crank drive shaft and the axle of the resistance fan wheel.
Figure 13:
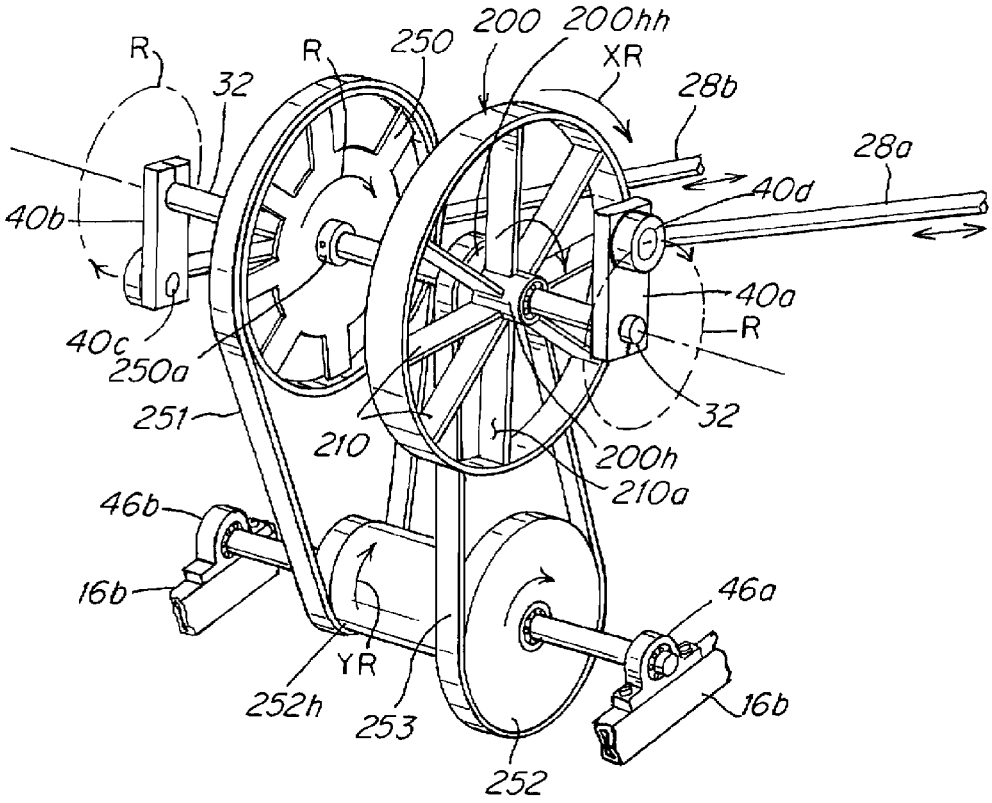
FIG. 13 is a generic left side view of the front ends of the FIGS. 1-12 apparatuses showing in exploded format for purposes of illustration a typical arrangement of rotation increasing pulleys and drive belts that can be interconnected between the primary crank drive shaft and the axle of the fan wheel.
Figure 14:
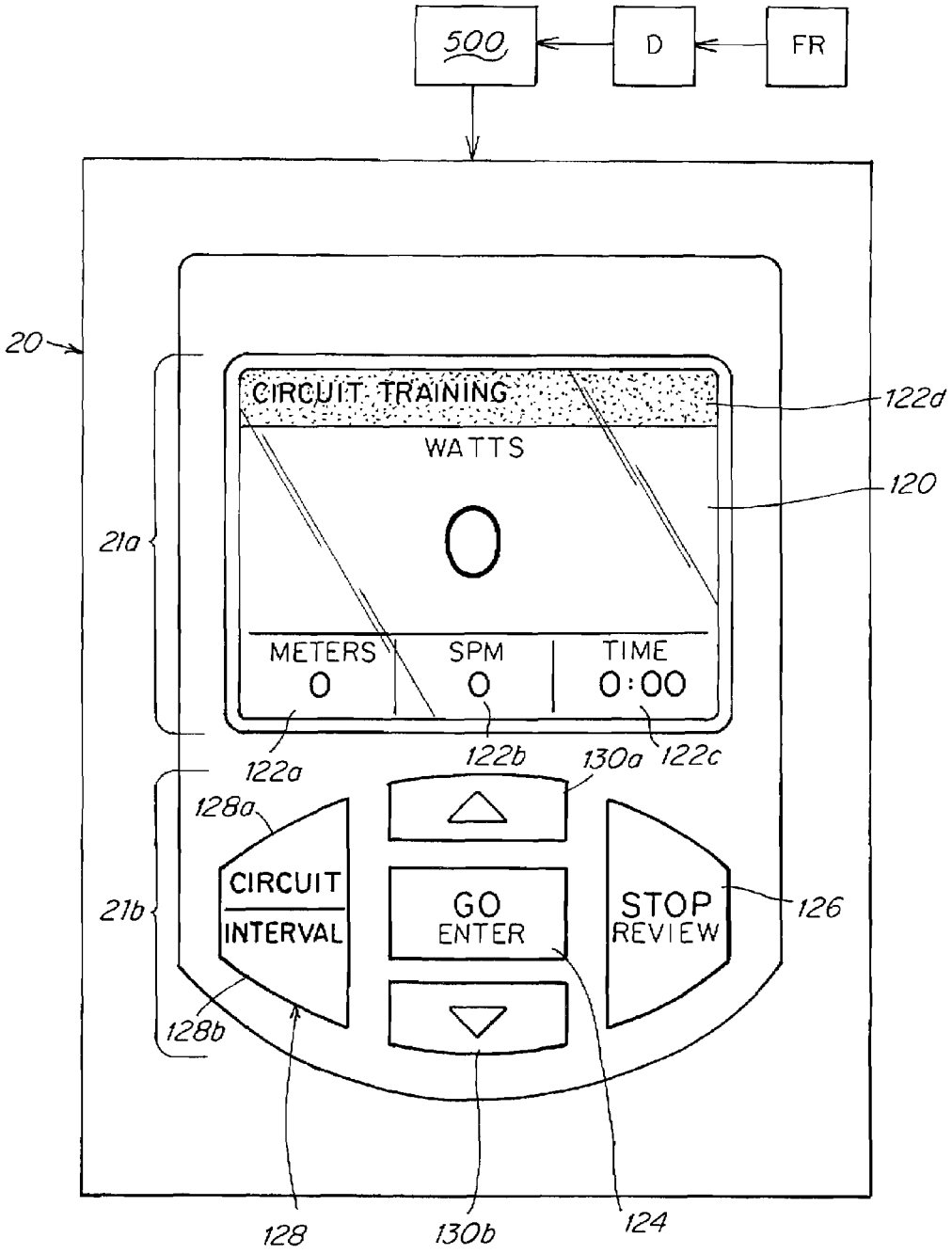
FIG. 14 is a schematic front view of a user interface interconnected to a processor that can be mounted and arranged on the console region of any of the FIGS. 1-13 apparatuses such that a user can readily manually engage buttons and observe visual displays that are disposed on the user interface.

As shown in FIGS. 12, 14 a detector D can be used to detect any one or more movements or properties of the apparatus 10 or the user or a component of the apparatus 10 such as the speed and time of rotation or other movement of the resistance assembly, in the case of the FIGS. 2-3A, 5-12 embodiments a fan 200. The speed detector can comprise an optical detector, a magnetic field detector, a Hall effect sensor, a potentiometer, one or more limit switches or any other detector that is capable of sensing a relevant measurable movement (rotational, translational or the like) of a mechanical element or component of a relevant mechanical element such as a wheel like fan wheel 200, an axle like crankshaft 32, 252*h*, a belt like belts 251, 253, a pulley like pulleys 250, 252, a foot support like supports 24*a*, 24*b*, a support pivot arm like arms 26*a*-26*c* or any other moving element of the apparatus, the rate of movement of which can be converted by an algorithm to the output results desired to be displayed on a visual display on the display area 20*a* of the user interface 20. The rate of movement or property detected by the detector D is generically designated as FR in FIGS. 12, 14 for purposes of explanation, it being understood that FR can alternatively comprise a value indicative of a movement other than the rotational speed of the fan wheel that can be used in an algorithm to generate a calculation of a result indicative the mechanical power or work input into the resistance assembly, a result such as power, energy, velocity, strides per minute, distance of movement by foot or by a bicycle of predetermined configuration.

As shown, the detector D sends a signal indicative of FR to the processor 500 which processes the signal according to a predetermined algorithm to calculate a value indicative of any desired aspect of the user's performance of exercise or the result of the user's exertion of force or energy in performance of the back and forth movement of the foot pedals 24*a*, 24*b* of the apparatuses shown in FIGS. 1-13. In the examples of FIGS. 14-21, the algorithm included in the processor is designed to use the variable input of FR to calculate for example, the number of watts of power exerted by the user, the number of meters that the user would have traveled if riding a bicycle having a preselected configuration while generating such power as calculated from FR and the number of strides per minute that the user would have achieved exerting the power or force calculated by the algorithm based on the FR input as a variable to the algorithm. Where the rotational speed of the fan wheel 200 is sensed and used in an algorithm, other values or parameters peculiar to the wheel 200, such as the number, size and shape of fan blades, are included in the algorithm in order to generate a value for the moment of inertia of fan wheel 200 (alternatively, the value for the moment of inertia may be provided to the algorithm in advance, in the form of a static variable) the moment of inertia being used to calculate the desired result such as watts, power, energy, work, distance traveled, number of strides and the like. As can be readily imagined, one or more additional or different detectors could alternatively be used to sense a rotational or translational movement and send a signal to processor 500 that is indicative of the speed or velocity of such movement such as of a shaft 32, 252*h*, a belt 251, 253, a pulley 250, 252, a foot support 24*a*, 24*b*, a support pivot arm 26*a*-26*d* and, a signal indicative of such movements could be used in an appropriate algorithm to generate and display one or more visual results indicative of watts, energy or power exerted by the user, number of meters that the user would have traveled if riding a bicycle, number of strides per minute and the like.

The aforementioned algorithm can include instructions that carry out a mathematical compensation that accounts for the effects of air temperature and pressure dependencies in the determination of the mechanical power expressed by the rotation of fan wheel 200. While the derivation of a power figure based on a measurement of the angular, or rotational, velocity of a spinning fan is generally known in the art, such calculations assume a constant value for the density of the surrounding air. Pressure and temperature sensors (not shown) can provide additional inputs to the processor 500, allowing a real-time and accurate measurement of air density to be made and used in the algorithm that generates the desired output results for display on the user interface. For a gas, such as air, the relationship between the pressure (P), volume (V), and temperature (T) exhibits a known and mathematically predictable relationship, generally approximated via the Ideal Gas Law. It may be further derived that density is directly proportional to the pressure of the gas, and inversely proportional to the temperature of the gas. Therefore, the use of temperature and pressure sensor readings and inputs to processor 500 can enable a calculation of air density for purposes of calculating a more accurate value for the power generated by rotation of fan blade 200.

FIGS. 1-13 illustrate a typical back and forth stride-like foot and leg driven apparatus that provides a user-exerciser with a low impact workout yet offers the potential for an intensive cardiovascular workout by eliminating the unnatural motion and awkward foot alignments typical of many stair-climbing and elliptical training devices. The apparatus 10 provides one or more foot supports 24*a*, 24*b* movable along an arcuate path defined around a point P of rotation. The arcuate path is selectively divisible into machine defined, user selectable arc segments. The apparatus 10 includes a frame 16*a*, 16*b*, 16*c*, 16*d*, a frame linkage 26*a*, 26*b*, 26*c*, 26*d* movably engaged with the frame, one or more foot supports 24*a*, 24*b* movably engaged with the frame linkage, a crank 40*a*, 40*b* movably engaged with the frame, and in the embodiments shown, an arc segment selection or adjustment mechanism that pivots the location of the crank assembly with respect to the frame, and a drive linkage 28*a*, 28*b* movably engaging the frame linkage.

In alternative embodiments (not shown), the arc segment selection device or assembly can comprise an assembly of mechanical components that enable the user to select an arc segment without pivoting or moving the crank or resistance assembly relative to the frame.

FIGS. 14-21 illustrate a typical embodiment of a user interface 20 that is mounted and arranged on the frame 16 of the apparatus 10 such that a visual display and manually actuatable or engageable interface area 20*a* of the interface 20 is both readily manually accessible by a user and readily visually observable by a user when a user is standing on a foot support 24*a*, 24*b* in particular when standing upright on a foot support.

FIG. 1-3, 4-11 are view of various embodiments of an arc segment selectable exercise device that includes a frame 10 having a front region 12, a rear user disposition region 14, frame legs 16*a*, 16*b*, 16*c* and 16*d*, and frame upper supports 18*a*, 18*b*, 18*c*, and 18*d*. Upper supports 18*c* and 18*d* comprise the upper links of a pair of four bar linkages and part of the arcuate portion of the frame, terminate in legs 16*c* and 16*b* respectively and are an integral part of frame 10. A display/control panel 20 and hand grips 22*a* and 22*b* are secured to the upper supports 18*a* and 18*b*.

Foot supports 24*a* and 24*b* are sized to receive the foot of a user. Foot supports 24*a* and 24*b* are movably connected to, and supported by, forward linkages or legs 26*a* and 26*b*, and rear linkages 26*c* and 26*d*. Linkages 26*a*-26*d* are movably connected to the rear region 14 of frame 10 by upper supports or links 18*d* and 18*c*. Although the device is shown with opposing pairs of linkages supporting each foot support, other embodiments are contemplated having fewer or more linkages supporting and controlling the range and path of motion of foot supports 24*a* and 24*b* associated with the linkage(s).

The foot supports 24*a* and 24*b* approximate a shoed human foot in size and shape. They can include a non-skid surface and be bounded by one or more low lips to help a shoe remain in place on the foot supports during use. Alternately, straps may maintain each foot within the foot support to further retain the user's foot in place during use. However, as used herein, a "foot support" can also encompass any designated support such as a pedal, a pad, a toe clip, or other foot/toe/leg and device interface structure as is known in the art.

The forward linkages or legs 26*a* and 26*b* are movably connected to drive linkages 28*a* and 28*b*; and the drive linkages are in turn connected to the resistance mechanism (illustrated in FIGS. 2A, 3 and 4 and described below) concealed by a housing 30. In other embodiments, the drive linkages 28*a* and 28*b* can be connected directly to the foot supports 24*a* and 24*b*. Additionally, foot supports can be on or integral to either the forward linkages or to the one or more linkages joined to the frame.

As illustrated in FIGS. 1-3, 4-11, representative movable connectors 31*a*, 31*b*, 31*c*, and 31*d* include pivot assemblies, as known in the art, that provide smooth and easy relative rotation or reciprocal motion by elements joined by the pivot assemblies. Movable connectors 31*b* and 31*d* rotatably couple forward linkages or legs 26*b* and 26*a*, respectively, to upper supports or links 18*c* and 18*d*. Movable connectors 31*c* and 31*a* rotatably couple rear linkages 26*c* and 26*d*, respectively, to upper supports or links 18*c* and 18*d*. Other connection assemblies that permit similar motion are contemplated by the invention. The movable connectors allow for a smooth and controlled swinging of foot supports 24*a* and 24*b* in an arcuate path.

Figure 2:
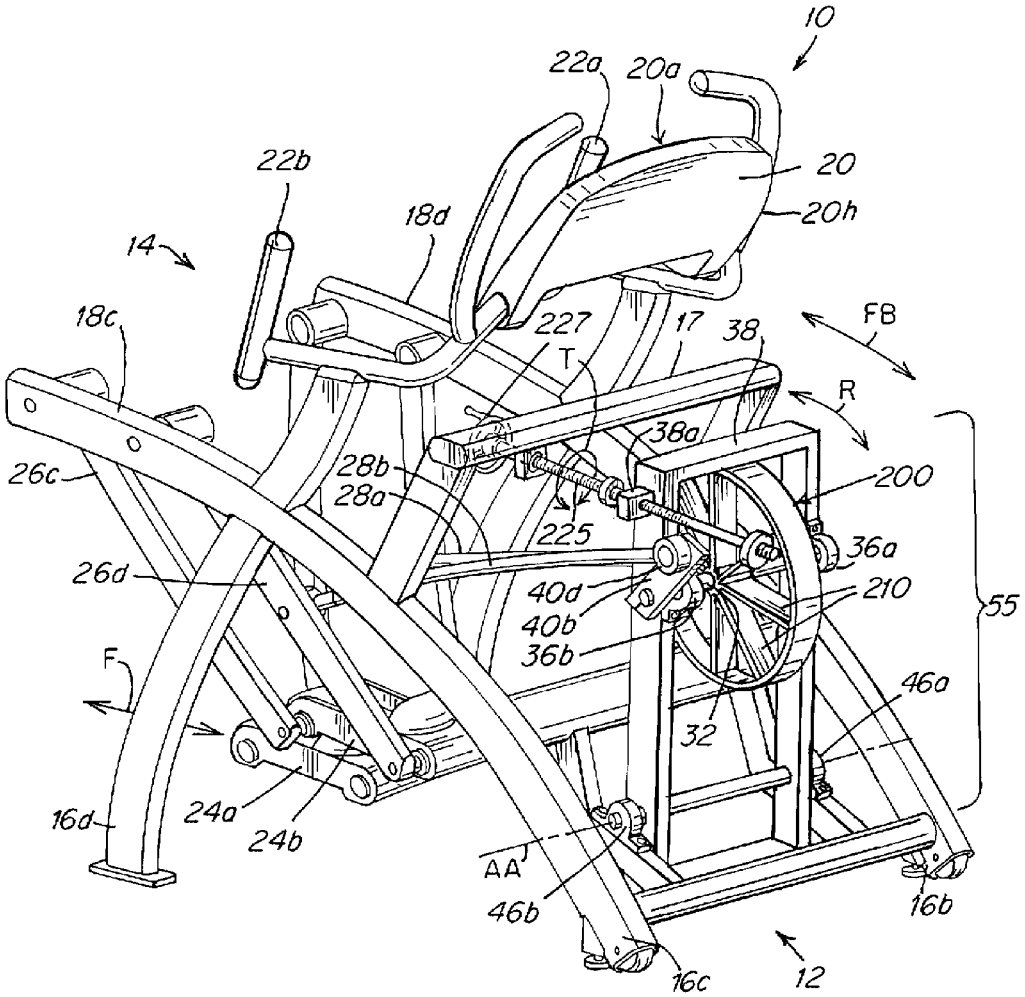
FIG. 2 is a front perspective view of the FIG. 1 apparatus showing the resistance assembly without a housing.

FIG. 2 is a front perspective view of one specific embodiment of an apparatus 10 as shown in FIG. 1 illustrating the elements described above from a different angle and showing in addition a manually engageable and actuatable screwable arc segment selectable mechanism 225 that is mechanically interconnected between the frame component 17 and the pivotable resistance assembly mounting bracket or arm 38. This illustration shows the device from the front region 12 perspective. Once again it can be seen that foot supports 24*a* and 24*b* are suspended from their respective linkages. Drive linkages 28*a* and 28*b* (not shown in FIG. 2) are coupled at their first ends to the substantial mid-point of front linkages or legs 26*a* and 26*b*, respectively. Drive linkages 28*a* and 28*b* are coupled at their second ends to a crank assembly 40*a*, 40*b*, 40*c*, 40*d* contained within housing 30, which contains the resistance assembly shown in FIG. 4 and described in greater detail below.

Figure 3:
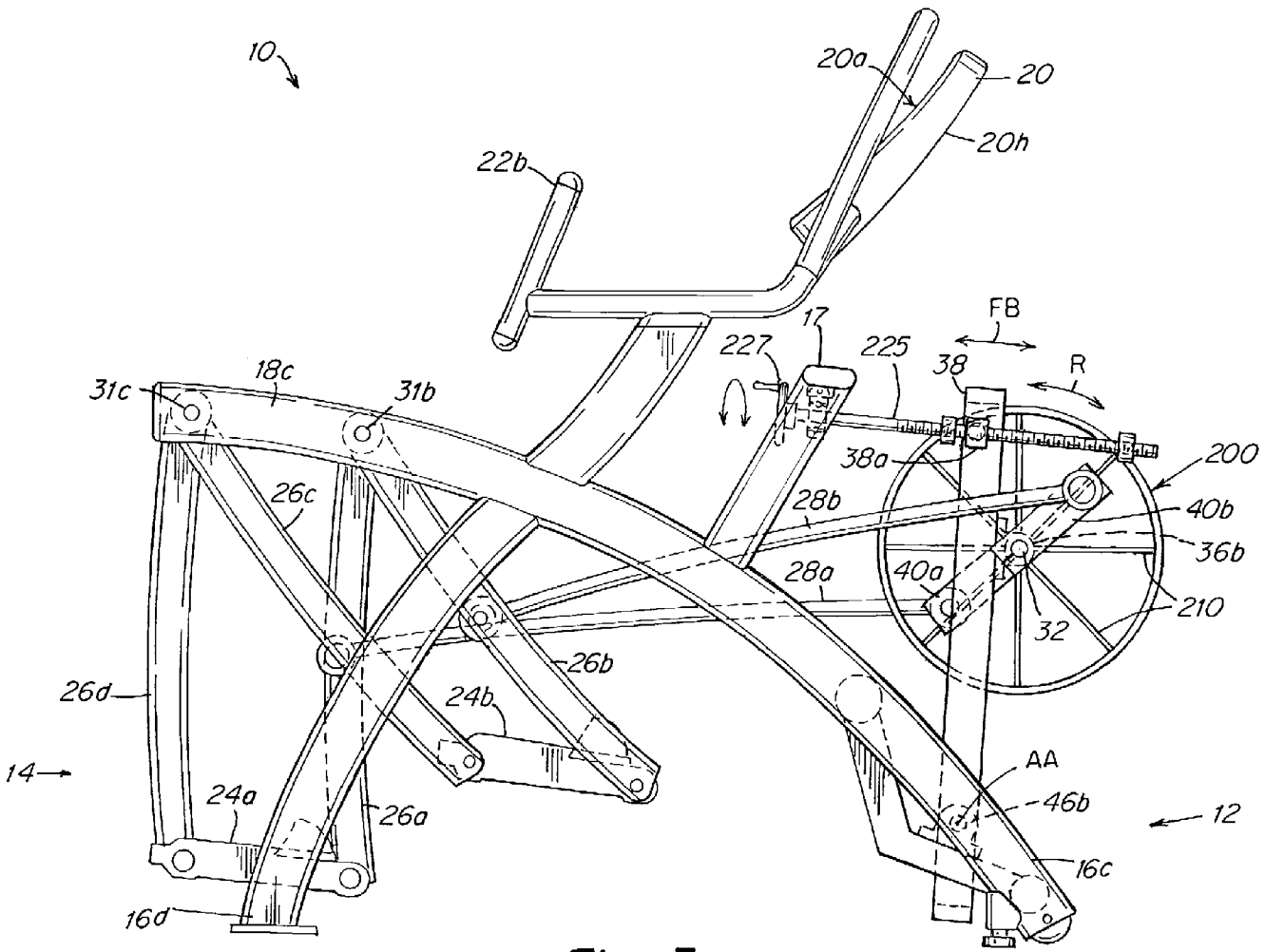
FIG. 3 is a right side view of the FIG. 1 apparatus showing the resistance assembly without a housing.
Figure 3A:
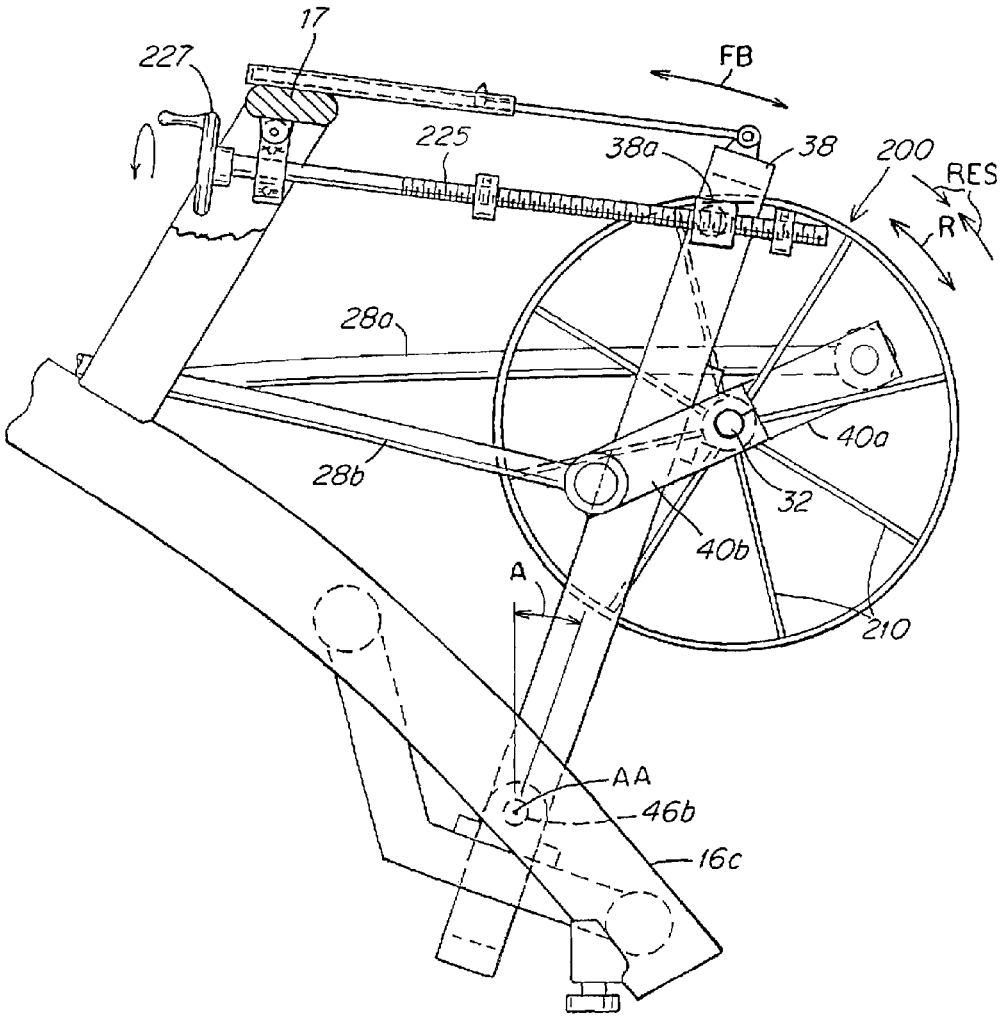
FIG. 3A is an enlarged right side view of a portion FIG. 3 showing the resistance assembly in a forwardly pivoted position relative to the position of the resistance assembly as shown in FIG. 3.
Figure 3B:
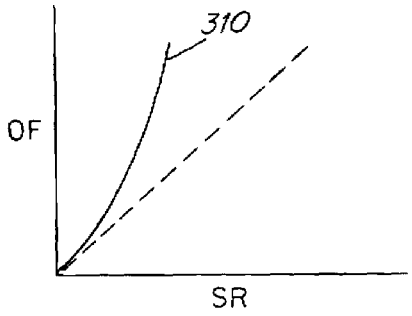
FIG. 3B is a plot showing the non-linearly increasing relationship between the degree of opposing force exerted by a fan wheel against the user's exertion of input force and the rotational speed of the fan.

As shown in FIGS. 2, 3, 3A, the screw 225 has a crank or wheel handle 227 connected to a proximal end of the screw 225 that is mounted so as to be readily manually accessible and engageable by a user located in the user disposition region 14 of the apparatus 10. The handle is readily rotatable or turnable by hand by a typical human user so as enable the user to readily effect rotation T of the screw 225 to any desired degree of rotation quickly and immediately upon manual engagement. The screw 225 is screwably engaged at distal position with a screw receiving bracket or nut 38*a*, FIG. 3, that is attached to the mounting bracket or arm 38 such that when the screw 225 is rotated either counterclockwise or clockwise, the bracket or arm 38 will pivot back and forth FB a selectable distance depending on the degree of rotation T of the screw. In the same manner as described below with reference to the manually drivable piston embodiments of FIGS. 5-8 the degree of such pivoting back and forth FB of bracket or arm 38 as determined by the degree and direction of rotation T of screw 225 enables the user to selectively change the identity of the particular arc segment through which the foot pedals will travel when the pedals are driven between a forwardmost upward and rearwardmost downward position. Depending on the particular arc segment chosen by the user, the degree of incline of the foot pedals and thus the degree of difficulty of driving the foot pedals 24*a*, 24*b* back and forth will vary. As shown in FIG. 3 the bracket or arm 38 is disposed in a first generally vertical disposition similar to the disposition shown in FIG. 5 where the horizontal component of the force F required is FH1 and vertical component of the force F required to move the foot pedals is FV1. As shown in FIG. 3A, the screw has been turned T such that the bracket or arm 38 is now disposed at an angle A relative to the position of FIG. 3 (similar to the difference in arm and foot pedal positions between FIG. 6 and FIG. 5) and the horizontal FH2 and FV2 components of force required to drive the foot pedals 24*a*, 24*b* through the new arc segment associated with the new pivoted position A of the bracket or arm 38 has changed relative to the position of the arm in FIG. 3 and thus degree of difficulty of the force F needed to perform an exercise cycle has been selectively changed by the user.

In each of the embodiments described herein the arc segment selection device is manually actuatable by the user to exert a selectable amount of manual force on the selection device that operates to selectively position, vary or adjust the resistance assembly in or to any one of a plurality of predetermined fixed mechanical positions that vary according to the selectable amount of manual force exerted by the user on the selection device. Such user force or energy exerted, manually driven arc segment selection systems are preferred so that a user can immediately without delay change an arc segment during the course of performing a circuit of different exercises in rapid sequential succession using different machines or otherwise performing different exercises that exercise different muscle groups at different periods of time during the course of the entire circuit of sequential different exercises.

In alternative embodiments, the selection device can be controllably driven by a motor or other electrically or electronically powered device rather than via exertion of a user's manual energy or force.

As shown in FIGS. 3, 3A, 5-9, 11-13, the resistance assembly can comprise a rotatably drivable R wheel 200 having fan blades 210 having surfaces 210*a* that engage against ambient air when the wheel is driven R. The degree of resistance to rotation R of the finned 210 wheel 200 increases or varies exponentially or non-linearly with the degree of speed of rotation R of the finned 210 wheel 200. Typically the degree of resistance RES, FIGS. 3A, 12 to rotation R of a fan or finned wheel 200 increases or varies by a cube or cubed factor of or with the degree of speed of rotation R. Other resistance mechanisms other than a finned 210 wheel 200 such as an Eddy current controlled brake mechanism can be employed that increase, decrease or vary in degree of resistance relative to the force F exerted by the user in a non-linear, geometric or exponential manner or relationship.

In the embodiment shown in FIGS. 2, 3, 3A, 5-8, 11 the axis of the resistance wheel 200 is connected directly to the axle 32 of a crankshaft such that the wheel 200 rotates R at the same speed of rotation as the crankshaft. Crank arms 40*a* and 40*b* are secured to each end of the crankshaft 32 and are movably coupled to the drive linkages 28*a* and 28*b*, respectively. As linkages 28*a*, 28*b* are driven back and forth as a result of back and forth foot driven movement of pedals 24*a*, 24*b*, crank arms 40*a*, 40*b* are rotatably R driven which in turn via their interconnection to shaft 32 rotatably R drive shaft 32 around its axis.

In alternative embodiments shown in FIGS. 9, 10, 12, 13 intermediate drive pulleys or wheels 250, 252 and associated belts 251, 253 are typically employed whereby the hub 200*h* of wheel 200 is not directly connected to and does not rotate in unison with shaft 32 but instead is rotatably driven at a higher rate XR than shaft 32 which is driven at rotation rate R. As shown, in FIGS. 12, 13 the crankshaft 32 is directly connected to the hub 250*a* of intermediate drive pulley 250 driving pulley at rate R. Drive pulley 250 in turn drives a second intermediate drive pulley or wheel 252 via belt 251 at a higher rotational rate of YR by way of an intermediate hub 252*h* that has a smaller radius than the radius of both of pulleys 250, 252. Intermediate drive pulley 252 in turn drives fan wheel 200 via belt 253 at an even higher rotational rate of XR by way of another intermediate hub 200*hh* to wheel 200 that has a smaller radius than radius of both pulleys 252 and 250. In a typical embodiment the ratio of XR to R is between about 10:1 and 20:1, most typically between about 13:1 and 15:1.

Rotation of the resistance wheel 200 as described herein whether the wheel 200 rotates in unison with the shaft 32 or at a higher rotational rate creates a resistance to the force F exerted by the user such that the degree of force resistance RES created by the wheel 200 varies exponentially or geometrically with the rate of rotation R or the amount of force exerted by the user on account the interaction of the surface 210*a* of the fan blades 210 that are mounted to the axle 220 of the wheel 200 with air. The faster that wheel 200 rotates the amount of air resistance against surfaces 210*a* of blades 210 increases exponentially or geometrically. Similarly, the rate of rotation generally varies non-linearly (exponentially or geometrically), with the degree of speed, velocity, force, work or power exerted by the user on the foot supports 24*a*, 24*b* or resistance assembly 200 et al. Typically the degree of resistance to rotation R of a fan wheel 200 increases or varies by a cube or cubed factor of or with the degree of speed of rotation of the wheel.

Top bearings 36*a* and 36*b* receiving the axle or crankshaft 32 are secured to a pivotable mounting bracket or arm 38 such that as pivotable bracket or arm 38 is pivoted forwardly and rearwardly, shaft 32 and its associated wheel 200 is pivoted forwardly and backwardly together with bracket or arm 38.

As shown in FIGS. 2-8 in order to drive the foot pedals through any selected arc segment, the user must exert a force F on foot pedals 24*a*, 24*b* that has a horizontal (or forward-rearward) component FH, FH1, FH2 and a vertical (or upward-downward) component FV, FV1, FV2. The degree of incline of the arc segment that the foot supports must travel through is determined by and will vary with the precise degree of the forward to rearward pivot position of bracket or arm 38 As shown in FIGS. 3-8 the mounting bracket or arm 38 pivots around the axis AA of bottom bearings 46*a* and 46*b* so as to be rotatable forwardly and rearwardly FB.

Figure 4:
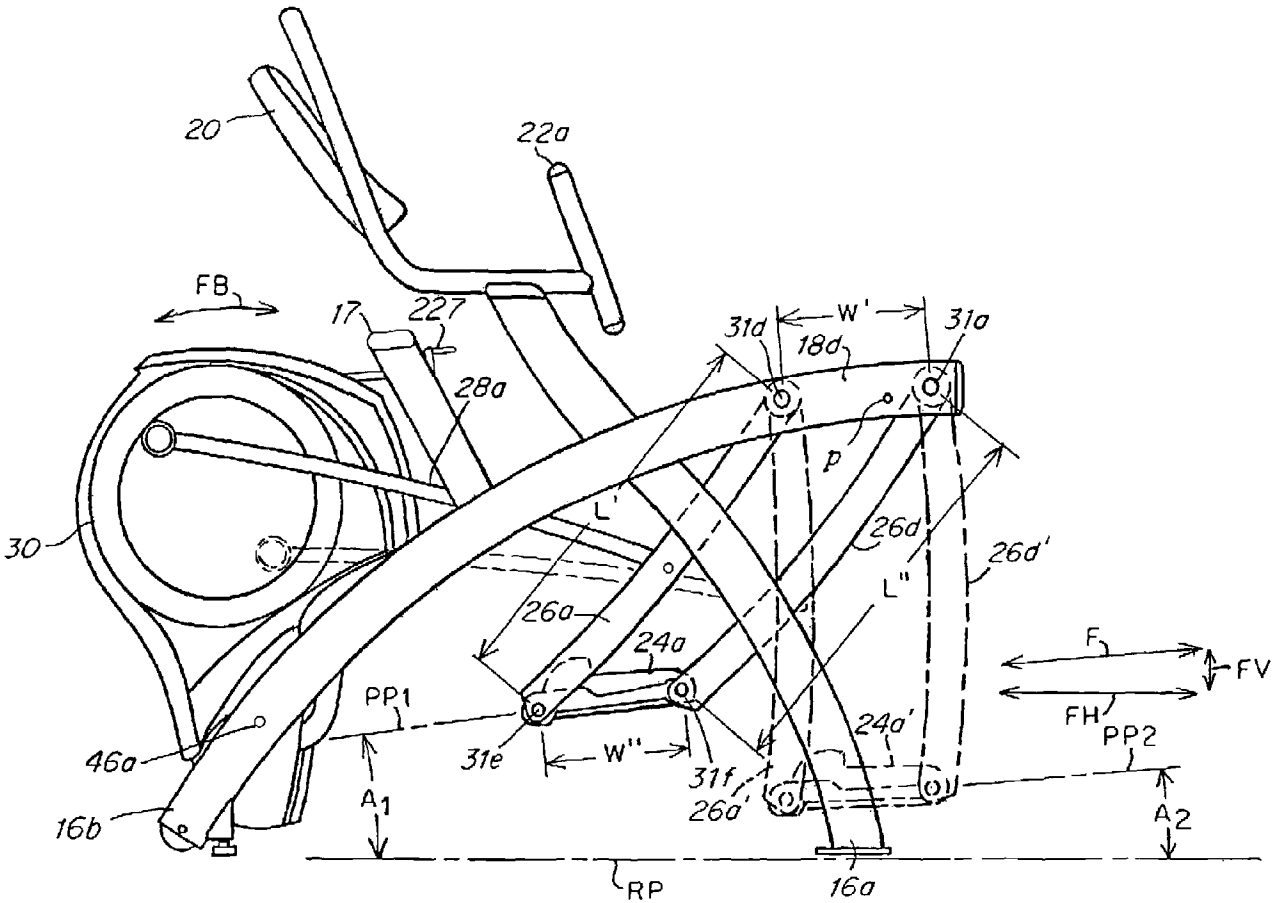
FIG. 4 is a left side view of the FIG. 1 apparatus.

FIG. 4 is a side view of an exercise apparatus 10. In this view, the foot supports 24*a* and 24*b*, forward linkages or legs 26*a*, 26*b* and rear linkages or legs 26*c*, 26*d* are presented from a perspective that allows ready visualization of the path that foot supports 24*a* and 24*b*, and thus a users feet, will traverse as the foot supports move fore and aft while suspended from the forward and rear linkages. It will be noted that as foot supports 24*a* and 24*b* move fore and aft, the forward and aft limit of motion is not unbounded. Rather, the range of motion is defined by the length of the crank arms 40*a* and 40*b* (shown in FIG. 4), which provide an appropriate stride length. Further, because the foot supports 24*a* and 24*b* are pivotally connected to, and swing with, the forward linkages 26*a*, 26*b* and rear linkages 26*c*, 26*d*, the foot supports travel a curved or arcuate path, and not an elliptical path, to provide more favorable biomechanics.

The motion path for the foot supports 24*a* and 24*b* can be selectively adjusted by adjusting the pivot position of mounting bracket or arm 38. As described above, the mounting 38 is pivotally mounted to the frame member 48 and pivots fore and aft upon selective manual actuation of a mechanical adjustment mechanism. As is evident by reference to the Figures, pivoting the mounting 38 forward moves the components such as wheel 200 secured directly or indirectly thereto forwardly. Likewise, pivoting the mounting 38 rearward causes the components secured directly or indirectly thereto to move rearward. This selective positioning FB of bracket or arm 38 causes the arcuate segment or motion path of the foot supports 24*a* and 24*b* to move to a different location along an arcuate path around a point of rotation "p", shown between pivot assemblies 31*b* and 31*c*, at a distance established by the length of the forward and rear linkages or legs 26*a*, 26*b*, 26*c* and 26*d*. Thus, the specific location on the master arc or arc segment ("the motion path") is user selectable to increase or decrease stride angle and location from a number of user selectable points, or arc segments, defined around the point of rotation.

In operation, a user approaches the device from the rear region 14, grasps the hand grips 22*a* and 22*b*, and places a foot on each of the foot supports 24*a* and 24*b*. The user's feet and legs begin to move fore and aft in a comfortable stride. The user selects an exercise program or manually adjusts the device by imputing commands via the display/control panel 20. Also, in response to command input, the mounting 38 is moved fore or aft. As shown, when the mounting 38 moves forward, the motion path of the foot supports is on a more inclined or vertical defined arc segment. To discontinue use of the device, a user simply stops striding, thereby causing the movement of the device to stop, and dismounts from the foot supports.

FIG. 4 illustrates one of the four bar linkage support mechanisms in a forwardmost, 26*a*', 26*d*' and a rearward 26*a*, 26*d* position along the pivot stroke of the four bar linkage. The four bar linkage has opposing pivot widths (or opposing pivot link, 18*c*/24*b*, 18*d*/24*a* widths), W' and W", and opposing pivot lengths (or opposing pivot link, 26*a*/26*d*, 26*b*/26*c* lengths), L' and L" that form the functional four bar linkage for purposes of pivotably mounting/supporting the foot pedal 24*a* from an upper portion 18*d* (or foot pedal 24*b* from upper portion 18*c*) of the overhead support arm or leg, 16*b*, 16*c*, of the frame. The foot pedals 24*a*, 24*b* themselves comprise a structural portion or the whole of the lower pivot link of the four bar linkages in the embodiments shown in FIGS. 1-10. The distances between the width pivot points 31*a* and 31*d*, W' and between the width pivot points 31*e* and 31*f*, W" are preferably equal or substantially equal. And, the distances between the length pivot points 31*d* and 31*e*, L' and between the length pivot points 31*a* and 31*f*, L" are also preferably equal or substantially equal such that the difference between angles A1 and A2, i.e. the degree of rotation or pivot of the foot pedal 24*a* from back to front and front to back along the arcuate path of translation of the foot pedal from front to back and vice versa is less than about 3 degrees, typically less than about 2.5 degrees. The foot pedals have a foot sole receiving upper surface that defines a generally planar orientation or plane in which the sole of the foot of the user is maintained when standing on a foot pedal. Angle A1 is the angle between the foot sole orientation plane PP1 in which the foot sole surface resides at the backwardmost end of the front to back path of translation and a fixed selected reference plane RP. Angle A2 is the angle between the sole orientation plane PP2 in which the foot sole surface resides at the forwardmost end of the front to back path of translation and the fixed selected reference plane RP. In this preferred embodiment, the difference between angles A1 and A2, at any point/position along the back to front/front to back path of translation of the food pedal 26*a* is preferably less than about 3 degrees (typically less than about 2.5 degrees), i.e. the plane in which the foot sole surface of the pedal 24*a* resides does not rotate or pivot more than about 3 degrees at any time during movement through the arcuate path of translation.

As can be readily seen from FIGS. 1-10, the foot pedals always travel in the same overall or master arcuate or other configuration of path of travel from front to rear and from rear to front. The master arcuate path of travel J, FIG. 5, that the pedals 24*a, b* may travel in remains the same regardless of what degree of pivot the bracket or arm 38 is positioned in. Pivoting the support bracket or arm 38 to different pivot positions only changes the arc "segment" (e.g. segment AP, FIG. 5, or segment AP', FIG. 6, or segment AP", FIG. 8) through which the pedals may travel from rearwardmost to forwardmost positions but does not change the overall or master path of arcuate travel J. The master arcuate path of travel J is defined by the machine or apparatus itself, i.e. by the mounting, positioning, lengths and widths of the links 18*c, d*, 24*a, b* and 26*a-d*. The user may select a segment of the overall machine defined arcuate path of foot pedal travel J depending on the degree of pivoting of bracket or arm 38 that the user selects for any given exercise session. As described below each segment selected will have a different degree of incline, e.g. H1 for segment AP and H2 for segment AP'.

In an alternative embodiment as shown in FIGS. 5-8 mounting bracket or arm 38 can be manually pivoted FB via extension or contraction of a mechanical arm 230 that acts as a tilt actuator to pivot the mounting bracket or arm 38 forwardly or backwardly as desired by the user. As can be readily imagined, arm 230 is manually actuatable by the user such as by the user's exerting a selectable degree of manual force by manually actuating a mechanical pumping or screwing mechanism 230*a* that mechanically causes the arm 230 to extend or contract to a desired degree that varies with the degree of mechanical force or energy exerted by the user and in turn mechanically pivots FB the bracket or arm 38 to a desired degree. As shown, the resistance mechanism 200 pivots forwardly and backwardly FB about the pivot axis A of bracket or arm 38 which is orthogonal to the longitudinal axis of the frame 10. Both of the pedals 24*a* and 24*b* are synchronized together by the motion of crankshaft 32.

Figure 5:
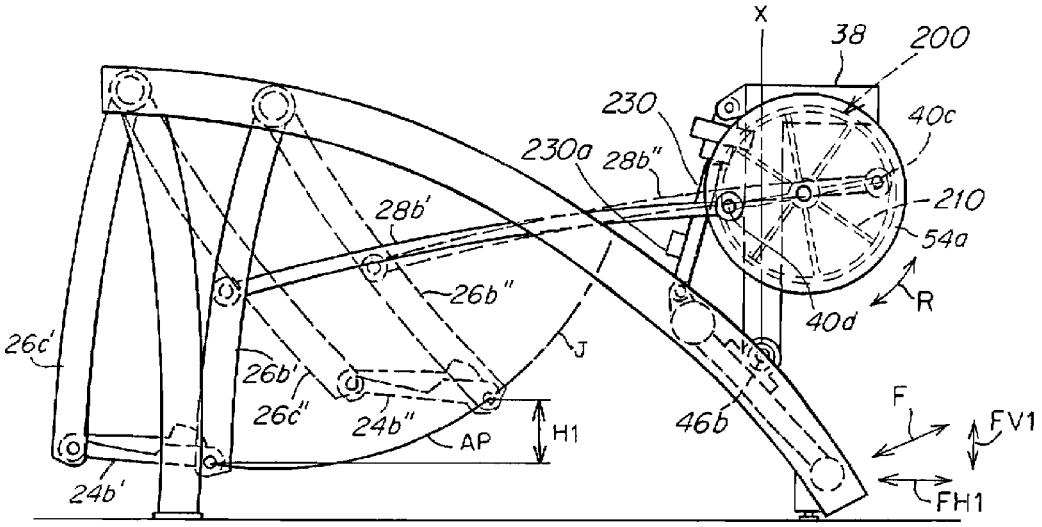
FIG. 5 is a right side view of another embodiment of an apparatus according to the invention having a manually actuatable pneumatic or hydraulic selection or adjustment device for selecting an arc segment.
Figure 6:
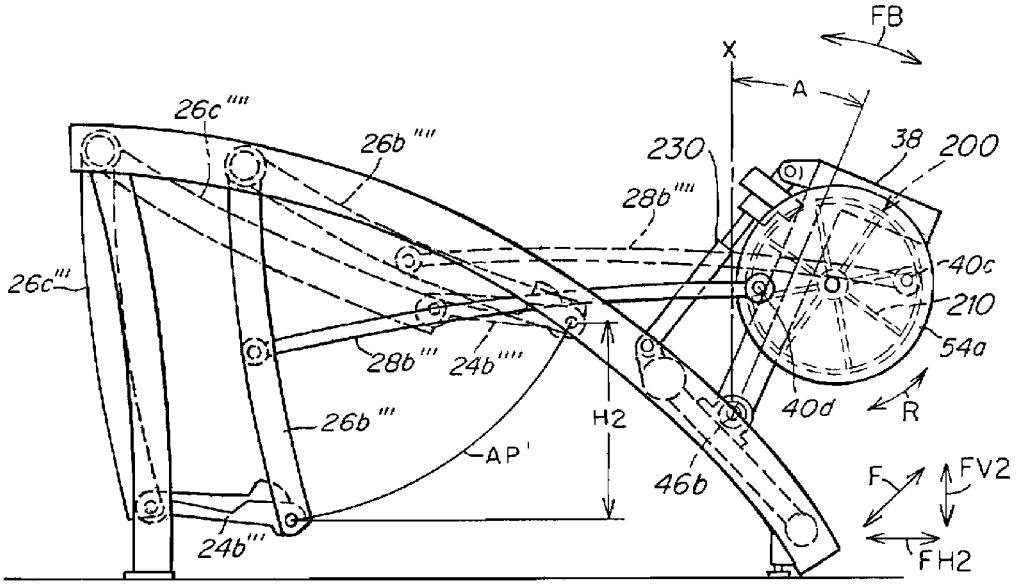
FIG. 6 is a right side view similar to FIG. 5 showing the resistance assembly and arc segment selection device in a forwardly disposed position relative to the position shown in FIG. 5.

FIGS. 5 and 6 more clearly illustrate the previously described selectability of an arc segment when the mounting member 38 and its associated wheel 200 or other resistance device is/are pivoted or tilted from one orientation to another. As shown in FIG. 5, the pivotable mounting bracket or arm 38 is positioned with its longitudinal axis X arranged in about a vertical orientation. In this orientation, the maximum difference in height or incline H1 between the rearwardmost position 24*b*' of the foot pedal 24*b* and forwardmost position 24*b*" of the foot pedal 24*b* is less than the maximum difference in height or incline H2 of FIG. 8 where the axis of the mounting member 38 and its associated components 30 have been tilted or pivoted forwardly by an angle A from the position of FIG. 5. As shown, the arcuate path AP of the pedals 24*b* in FIG. 5, going from position 24*b*' to 24*b*", is less steep or upwardly inclined than the arcuate path AP' of the pedals going from position 24*b*'" to 24*b*"" in FIG. 6. Thus, as shown, the user can select the degree of arc of travel of the pedals by selecting the position of tilt of assembly 30 to which the linkage bars 28*b* are attached.

As also shown in FIGS. 5 and 6 the pedals travel along the same selected arcuate segment path AP or AP' from front to rear and from rear to front one the pivot position of bracket or arm 38 is selected.

Figure 7:
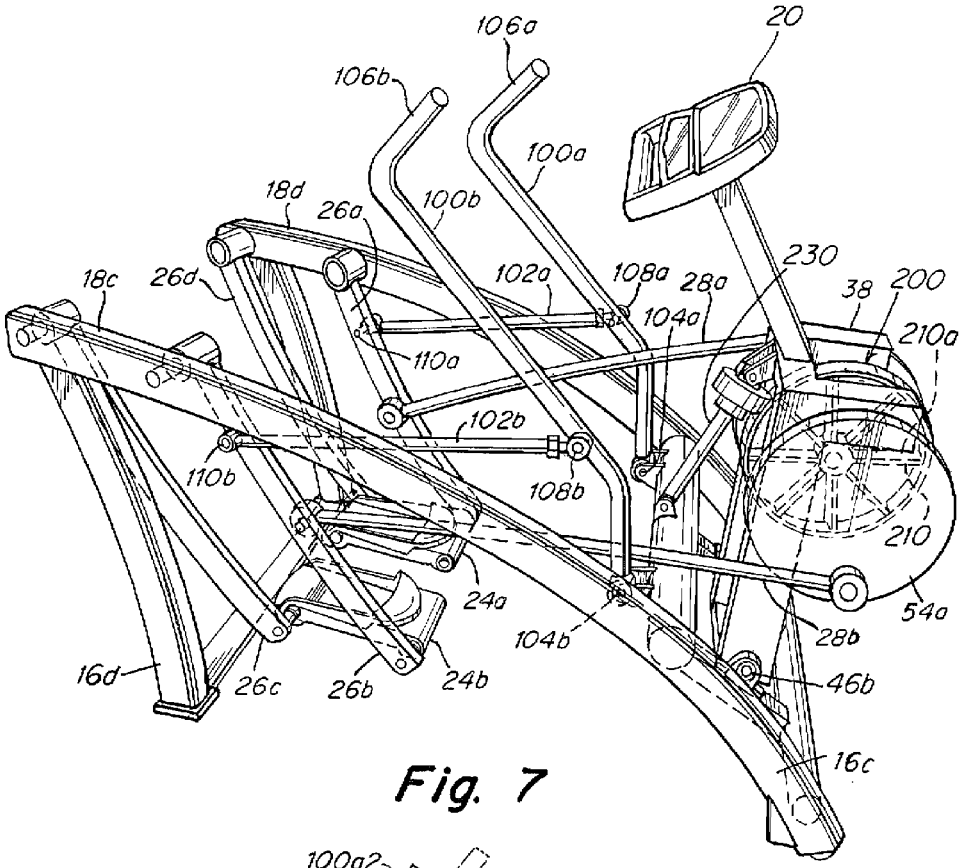
FIG. 7 is a right side perspective view of the FIGS. 5-6 apparati having a pair of pivotable handles pivotably attached to the forward four bar linkage legs 26*a*, 26*b* and to the frame.
Figure 8:
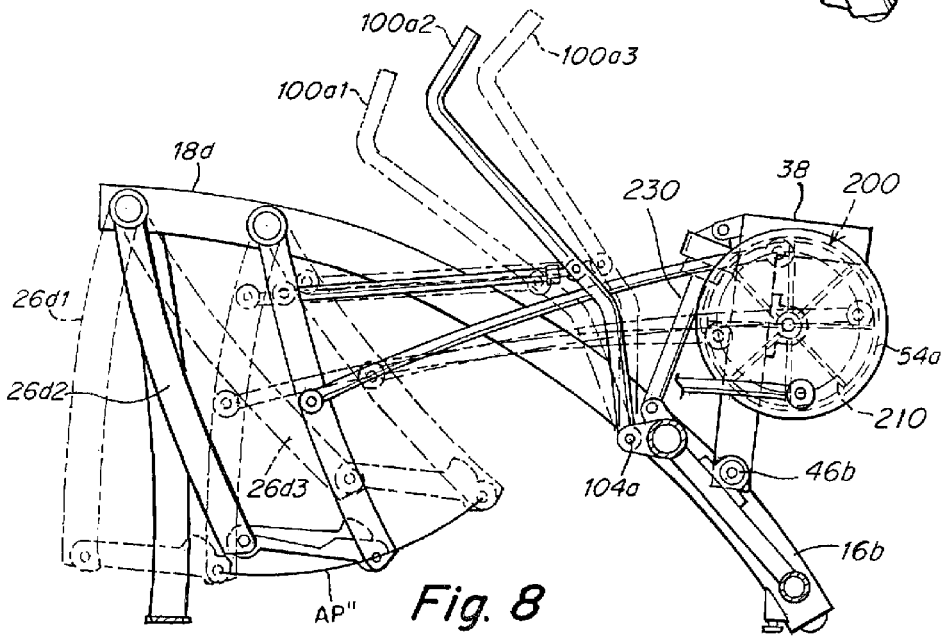
FIG. 8 is a right side view of the FIG. 7 apparatus.
Figure 9:
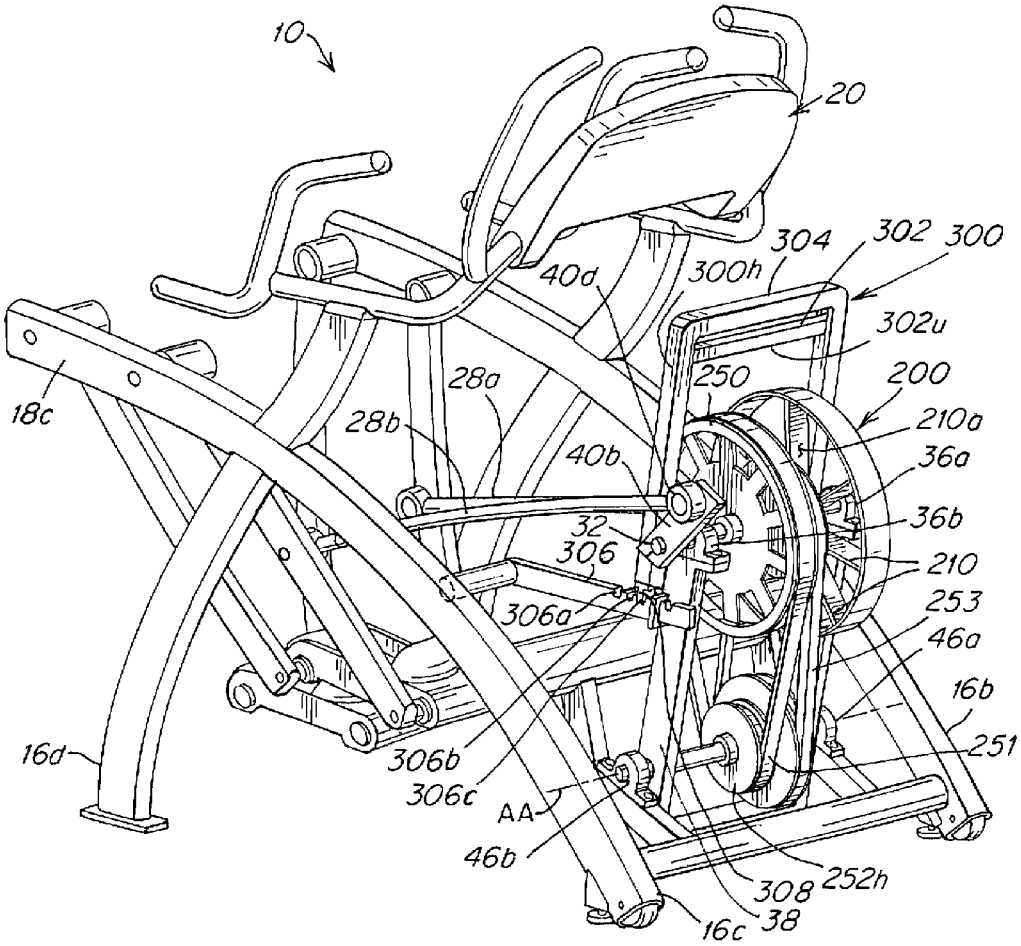
FIG. 9 is a right side perspective view of another embodiment of an apparatus according to the invention having a manually actuatable U-shaped handle as the selection or adjustment device for selecting an arc segment.

FIGS. 7 and 8 show an embodiment where a pair of pivoting upper body input arms 100*a*, 100*b* are provided that the user can manually grasp by hand at an upper region such as handles 106*a*, 106*b*, the handles 106*a, b* being a rigidly connected extension of arms 100*a*, 100*b* respectively and moving/pivoting together with the arms forward or backward. The handles 106*a*, 106*b* and arms 100*a*, 100*b* are pivotably interconnected to both the frame and to the pedals. As shown the handles 106*a*, 106*b* and arms 100*a*, 100*b* are pivotably interconnected to the frame via a cross bar member 500, the bottom ends of the arms being freely pivotably mounted via pin/aperture joints 104*a*, 104*b* at their bottom ends, the joints being attached to bar support member 500 at appropriate distances from each other along the length of bar support 500. Arm linkage members 102*a*, 102*b*, are pivotably attached at one end to the arms at joints 108*a*, 108*b* which allow the linkage members to rotate/pivot on and with respect to the arms. Linkage members 102*a*, 102*b* are also pivotably attached at another end to some component of the arcuate path traveling assembly of foot pedal, and four bar linkage supports 26. As shown in FIGS. 9, 10 an end of the linkages 102*a*, 102*b* distal from the arm connection point are pivotably attached to the forward longitudinal four bar linkage members 26*d*, 26*a* respectively via joints 110*a*, 110*b* that allow the linkage members to rotate around the axes of the joints, the joints interconnecting the linkage members 102*a, b* and the longitudinal four bar linkage members 26*d, a*.

As shown in FIGS. 7, 8 as the foot pedal assemblies 24, 26 travel along the arcuate path AP" from either front to back or from back to front, the handles 106 and arms 100 follow the front to back movement of the pedals with a pivoting front to back or back to front movement. That is, when the right pedal 24*a* moves forwardly the right handle 106*a* and arm 100*a* pivot or move forwardly; when the right pedal 24*a* moves backwardly the right handle 106*a* and arm 100*a* pivot or move rearwardly; when the left pedal 24*b* moves forwardly the handle 106*b* and arm 100*b* pivot or move forwardly; when the left pedal 24*b* moves rearwardly the handle 106*b* and arm 100*b* pivot or move rearwardly. Such following motion is shown for example with reference to four bar linkage arm 26*d* in three sequential front to back positions 26*d*1, *d*2 and *d*3 which correspond respectively to arm 100*a* positions, 100*a*1, *a*2, *a*3. The degree of front to back pivoting of the arms 100*a, b* can be predetermined at least by selective positioning of the pivot joints 108*a*, 108*b*, 110*a*, 110*b*, selective positioning of cross bar 500 and selection of the lengths of linkage arms 102*a*, 102*b*.

In the FIGS. 7, 8 embodiments, the user can reduce or transfer the amount of energy or power required by the user's legs and/or feet to cause the foot pedals to travel along the arcuate path AP" from back to front by pushing forwardly on the upper end of the arms 102*a*, 102*b* during the back to front pedal movement. And, the user can increase the speed of forward movement by such pushing; or reduce the speed and increase the power or energy required by the legs to effect forward movement by pulling. Conversely the user can reduce or transfer the amount of power or energy required to cause the pedals to move from front to back by pulling backwardly on the upper end of the arms. And, the user can increase the speed of rearward movement by such pulling or reduce the speed by pushing; or reduce the speed and increase the power or energy required by the legs to effect rearward movement by pushing.

The four bar linkage foot assemblies, 24*a*, 26*a, d*, 18*d* and 24*b*, 26*c, b*, 18*c* that are pivotably linked via the linkages 102*a*, 102*b* to the pivotably mounted arms 100*a*, 100*b* can be configured to enable the foot pedal and the plane in which the sole of the foot is mounted to either not rotate or to rotate/pivot to any desired degree during front to back movement by selecting the lengths L' and L" and widths W' and W", FIG. 4 appropriately to cause the desired degree of rotation/pivoting. These four bar linkage assemblies also, via the above described linkages to the arms 100*a, b*, cause the arms to travel along the same path of pivot from front to back and back to front.

In the embodiment shown in FIGS. 4-8, the linkages 28*a*, 28*a*', 28*a*", 28*a*'" and 28*b*, 28*b*', 28*b*", 28*b*'" are interconnected to the wheel 200 via the four bar linkage and the linkages 28*a*, 28*b* at opposing 180 degree circle positions 40*c* and 40*d* from the center of rotation of the crank arms 40*a, b* and/or shaft 32, i.e. the linkages are connected at maximum forward and maximum rearward drive positions respectively. This 180 degree opposing interconnection causes the right 24*b*, 24*b*', 24*b*", 24*b*'" and left 24*a*, 24*a*', 24*a*" and 34*a*'" foot pedals to always travel in opposite back and forth translational directions, i.e. when the right pedal is traveling forward the left pedal is traveling backwards and vice versa. Similarly, the pivotably mounted arms 100*a* and 100*b* are interconnected to the bracket or arm 38 and wheel 200 via the four bar linkage, the links 28*a*, 28*b* and the links 102*a*, 102*b* such that when the right arm is moving forward the left arm is moving backward and vice versa. As shown in FIGS. 7, 8 the arms 100*a*, 100*b* travel forwardly or backwardly together with their associated foot pedals 28*a* and 28*b* respectively.

In any event, the left and right side pedals 24*a, b* and input arms 100*a, b* are linked to the resistance 200 or drive assembly 28*a*, 28*b*, 40*a*, 40*b*, 32 such that when the left side components (i.e. left pedal and associated input arm) are traveling forward the right side components (i.e. right pedal associated input arm) are traveling backward for at least the majority of the travel path and vice versa.

The upper body input arms 100*a, b* are interconnected or interlinked to the same pivotable mounting member 38 as described above via the links 102*a, b*, four bar linkage members 26*a, b* and links 28*a, b* as shown in FIGS. 7, 8. In the same manner as forward or backward pivoting of the mounting member 38 changes the degree of incline and/or path of travel of foot pedals 24*a, b* as described above with reference to FIGS. 5, 6, a forward or backward pivoting of the mounting member 38 also changes the degree of back to front pivoting and/or the degree of path of travel of arms 100*a, b*. Thus, in the same manner as the user is able to select the degree of incline of the path of travel of the foot pedals, e.g. arc path segment AP versus arc path segment AP' as shown in FIGS. 5, 6 and also described above with regard to mount member 38 enabling the user to select the degree of arc segment stride length and angle/incline, the user is able to select the degree of back to front/front to back pivot stroke or travel path of input arms, 100*a, b*, by adjusting the front to back pivot position FB of the center of rotation of rotation connection/interconnection points 40*c* and 40*d*.

The input arms 100*a, b* are linked to the foot pedals 24*a, b* in a manner that causes an input arm (e.g. 100*a*) to move forwardly as its associated foot pedal (24*a*) moves forwardly and upwardly, or conversely that causes an input arm to move backwardly as its associated foot pedal moves backwardly and downwardly along the user selected arc segment.

FIGS. 9-10 illustrate an alternative manually actuatable mechanism for mechanically adjusting FB the position of bracket or arm 38 and thus the selection of a particular arc segment. In the FIGS. 9-10 embodiment, the manually adjustable element comprises a U-shaped handle assembly 300 that is attached to pivoting bracket or arm 38. The handle assembly includes a locking arm 307 that is spring load biased in a downward DN direction such that the distal end tooth 308 is biased into being received within a selected one of forward to back FB fixed position slots 306*a*, 306*b*, 306*c*, etc that are provided within fixedly mounted arm 306. Pivotable movement of the handle assembly 300 in the FB direction pivots the bracket or arm 38 and any associated resistance mechanism such as fan 200 in unison around pivot point AA thus changing the arc segment depending on the degree of movement of the handle assembly 300 in the FB direction. As shown the handle assembly 300 can be pivoted around axis AA between a plurality of preselected fixed back and forth positions, 306*a*, 306*b*, 306*c*, etc depending on the number and precise location of slots 306*a*, 306*b*, 306*c*, etc that are provided within the upper surface of positioning bar 306 that is fixedly attached or interconnected to the frame 16*a*-16*d*, 18*a*-18*d*. Back forth positioning of the handle assembly 300 and its fixedly interconnected bracket or arm 38 between preselected fixed positions can be achieved by the user's manually grabbing the upper handle element 304 and simultaneously squeezing upwardly UP, FIG. 10 on the underside surface 302*a* of spring loaded trigger 302 to cause the trigger 302 and its interconnected arm 307 that is slidably mounted within an arm housing 300*h* to move upwardly UP, FIG. 10 toward the handle 304 such that the distal end of the arm 307 which comprises a tooth 308 complementary in shape to the slots 306*a*, 306*b*, 306*c*, etc becomes disengaged and is withdrawn out of whichever slot 306*a*, 306*b*, 306*c*, etc that the tooth is locked into by the downward DN spring load that is exerted on trigger 302 and arm 307 by the spring mechanism (not shown). As in the FIGS. 2-3, 5-8 embodiments, in such a FIG. 9-10 embodiment therefore, depending on the degree or amount of manual force exerted by the user in the FB' direction on handle assembly 300, an arc segment AP, AP' having a selected and different degree of incline and requiring a selected and different degree of force F to move horizontally FH1, FH2 and vertically FV1, FV2 can be manually selected by the user by the exertion of a selected amount of manual force on the arc segment selection device 300.

FIGS. 11-12 illustrate another alternative manually actuatable mechanism for mechanically adjusting the position FB of bracket or arm 38 and thus the selection of a particular arc segment. In the FIGS. 11-12 embodiment, the manually adjustable element comprises an elongated cylindrical handle assembly 400 comprising a tube or tubular handle 404 pivotably mounted to the frame 16*a*-16*b*, 18*a*-18*b*, for back and forth FB' movement, a rod or trigger 406 slidably mounted within the handle 404 rod that is spring load biased in an upward UP direction by a spring (not shown), a bracket 402 with upwardly extending slots 402*a*, 402*b*, 402*c* and a lever assembly 404 that is pivotably interconnected between the handle 404 and the resistance mounting bracket or arm 38. Back forth FB' positioning of the handle 400 and FB its pivotally interconnected bracket or arm 38 between preselected back and forth fixed positions that correspond to slots 402*a*, 402*b*, 402*c* can be achieved by the user's manually grabbing the handle 404 and simultaneously pushing downwardly DN, FIG. 12 on the top surface 406*a* of spring loaded trigger 406 to cause the trigger 406 slidably mounted within handle 404 to move downwardly DN such that a pin 406*b* that projects laterally from the sliding rod or trigger 406 is disengaged from within whichever of slots 402*a*, 402*b*, 402*c* that the pin 406*b* is received within. Once the trigger 406 is manually actuated downwardly DN a distance sufficient to release pin 406*a* from a slot 402*a*, 402*b*, 402*c*, the user can manually exert a selected amount of back and forth FB' directed force that in turn pivots the mounting bracket or arm 38 and its associated resistance assembly to a selected back and forth FB position. Once a desired back and forth FB' position is reached, the user releases downward force on the trigger surface 406*a*, the trigger 406 is urged upward UP and the locking pin 406*b* is allowed to be received into a selected one of the slots 402*a*, 402*b*, 402*c* thus locking the handle assembly 400 and mounting arm into a selected forward to back FB position. As in the FIGS. 2-3, 5-8 embodiments, in such a FIG. 11-12 embodiment, therefore, depending on the degree or amount of manual force exerted by the user in the FB' direction on handle assembly 400, an arc segment AP, AP' having a selected and different degree of incline and requiring a selected and different degree of force F to move horizontally FH1, FH2 and vertically FV1, FV2 can be manually selected by the user by the exertion of a selected amount of manual force on the arc segment selection device 400.

Although the wheel 200 with fan blades 210 is the preferred resistance assembly, other resistance devices that create resistance that varies non-linearly with the degree of speed, velocity, force F, work or energy exerted by the user on the foot supports or resistance assembly are known to those skilled in the art and can be interconnected to the foot pedals 24*a*, 24*b*.

FIG. 14 is a detailed view of the interface console region 20 of the present invention, consisting of an LCD type visual display 21*a* and user operated panel of manually actuatable or engageable push-buttons 21*b*. By its nature, the LCD type visual display is capable of executing multiple different interfaces or information-carrying images, described in detail below. The panel of push-buttons remains fixed, with each button achieving a specified function.

Button 128, labeled "CIRCUIT|INTERVAL" permits the user to quickly and easily select the desired mode of operation—accordingly, he or she simply depresses the top portion 128*a* to enter Circuit Training Mode, and depresses the lower portion 128*b* to enter Interval Training Mode. Up and down arrow keys, 130*a* and 130*b* respectively, allow the user to toggle between consecutive numerical values when setting inputs such as desired time or desired number of intervals. Button 124, labeled "GO ENTER", functions as a confirmation tool, allowing the user to begin the workout routine as well as approve input values or any other user-system dialogues and interactions. Button 126, labeled "STOP REVIEW", serves the opposite purpose, allowing the user to terminate the workout routine and/or enter review mode.

As shown in FIG. 14, a user interface 20 is comprised of an LCD visual display 21*a* that displays the default interface for a Circuit Training Mode, characterized by a menu label 122*d* reading "CIRCUIT TRAINING", such that the user may easily ascertain the selected mode of operation at any given moment in time. All output values read "0", as the user has not yet begun the workout routine. In this interface, the primary visual display area 120 displays the user's instantaneous output power, measured in units of Watts. The secondary visual display area 122 displays more detailed information in the form of meters traveled (122*a*), SPM or Strides Per Minute (122*b*), and time elapsed (122*c*).

After mounting the exercise device, the user simply presses the "Go" button 124 and begins the workout routine. Time counter 122*c* begins tracking elapsed time, updating every second. The SPM display 122*b* measures the rate at which the user actuates the movable foot supports back and forth, with periodic updates on the order of one second. The meters traveled visual display 122*c* tracks cumulative distance over the course of the entire workout routine, updating only when a new integer value of distance is achieved. Of course, this figure refers not to a literal distance traveled by the user's body, but rather, the cumulative distance of the path(s) executed by the user's feet.

The user is not required to press the "Go" button 124 to begin a workout routine providing an additional degree of flexibility and ease of use to the hurried or novice user. By simply actuating the movable foot supports into their back and forth motion, the interface console is activated, the only difference being that a more limited set of information is subsequently presented to the user. Primary display area 120 will provide a reading of instantaneous power output in Watts exactly as described above, and SPM 122*b* will likewise function in an unchanged manner, because these instantaneous values are not time dependent in their measurement. However, display areas 122*a* and 122*c*, meters and elapsed time, respectively, will have no output. They are accumulated, time-dependent values, and as such, cannot be accurately displayed in the absence of a discrete, user-defined starting point.

Figure 15:
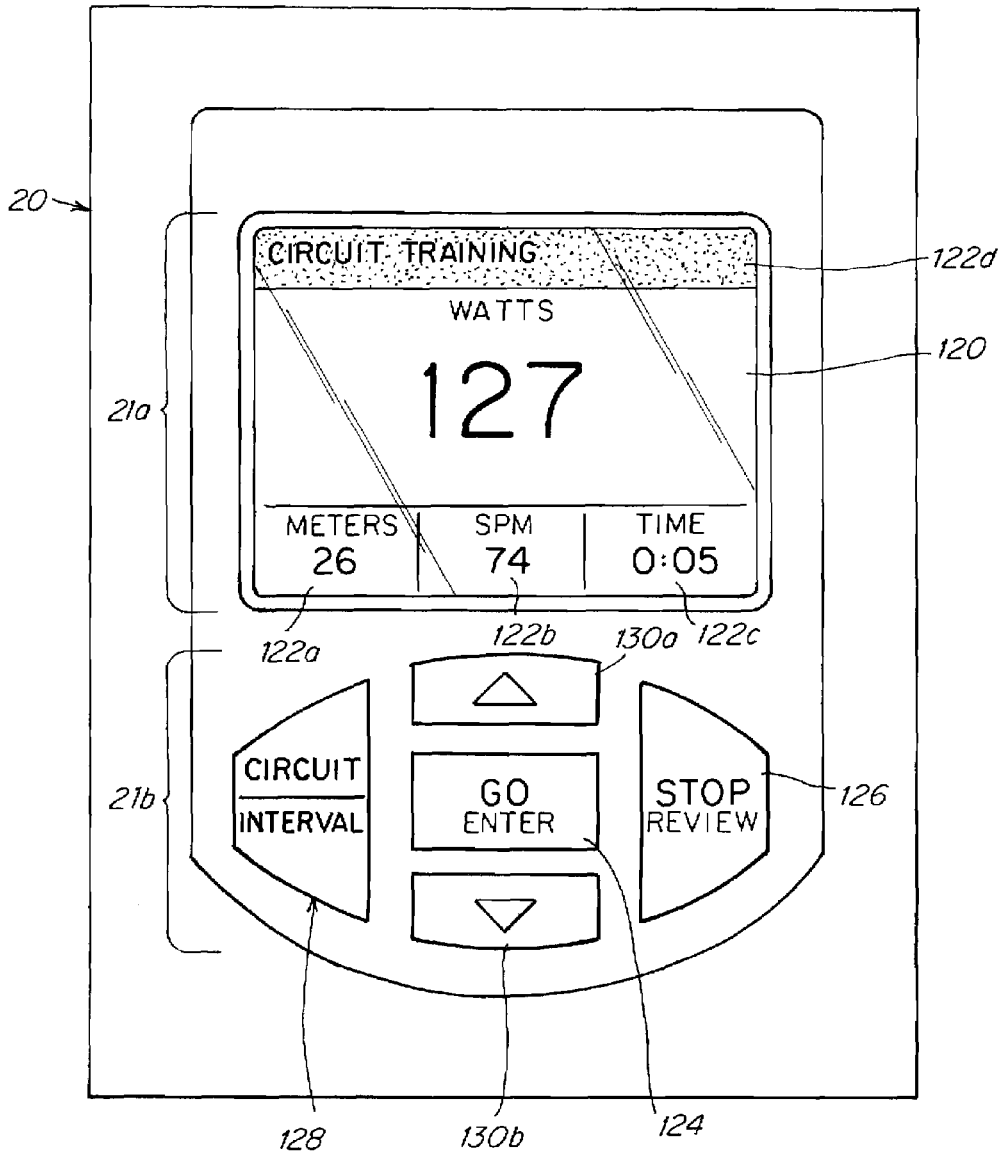
FIG. 15 is a view of the FIG. 14 interface showing an example of the appearance of various displays of the interface after the "circuit" and GO buttons have been actuated and a user has begun an exercise routine.

FIG. 15 illustrates an example in which a user has begun a workout routine. The display interface itself is identical to that of FIG. 1, the only change being in the values presented. Accordingly, display area 122*c* indicates that the workout routine has been performed for 5 seconds, in which time the user has traveled a distance of 26 meters. Note that the presence of values in display areas 122*a* and 122*c* indicates that the "Go" button 124 was used to initiate this workout routine.

Display areas 120 and 122*b* display the user's instantaneous output in terms of Power and SPM, respectively. As this workout is ongoing, input commands from buttons in panel 21*b* would have no effect, with the one exception being "Stop" button 126, which is employed to terminate the workout routine and all timing mechanisms.

Figure 16:
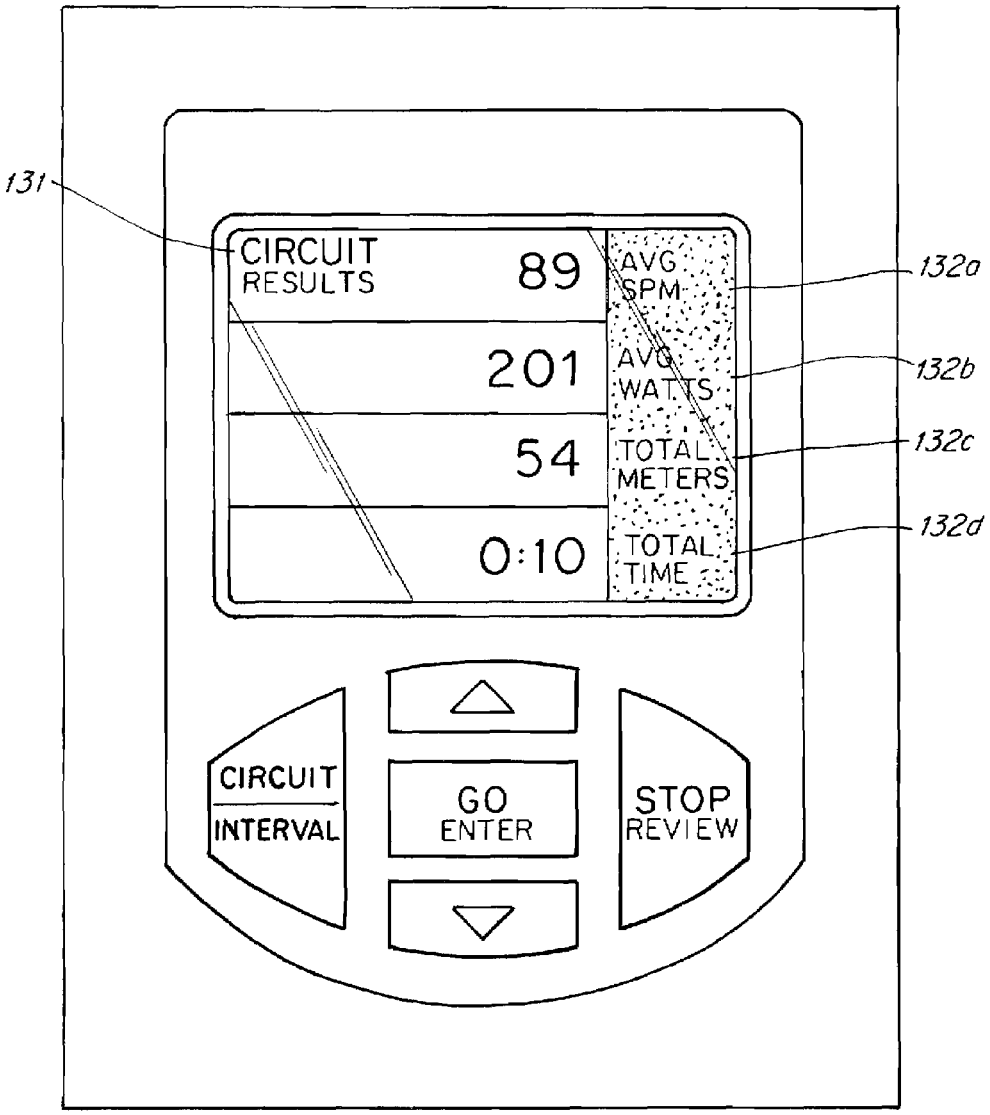
FIG. 16 is a view of the FIG. 14 interface showing an example of the appearance of various displays of the interface after the "circuit," GO and STOP review buttons have all been actuated and a user has ended an exercise routine.

After completing the workout routine and pressing "Stop" button 126, the interface of display 21*a* is replaced with a review interface, seen in FIG. 16. Label 131 in the top left corner indicates at all times to the user that the mode of operation is and was set to Circuit Training Mode, and furthermore, that the interface console is in the review interface. This review interface is only accessible after those workouts which were initiated by pressing the "Go" button 124. For those cases in which the button was not pressed, the display will return to the default interface depicted in FIG. 1 after the user ceases operation of the exercise device.

The review interface is designed to be simple and easy to understand, introducing no new measurements or other factors. It presents the user with just four values, tabulated into either averaged or accumulated form. Display areas 132*a* and 132*b*, average SPM and average Power, respectively, are averages that are measured over the complete duration of the workout routine, and provide a convenient form for the user to characterize his or her overall physical performance or output. Display areas 132*c* and 132*d* are the accumulated values for meters traveled and time elapsed, respectively.

Figure 17:
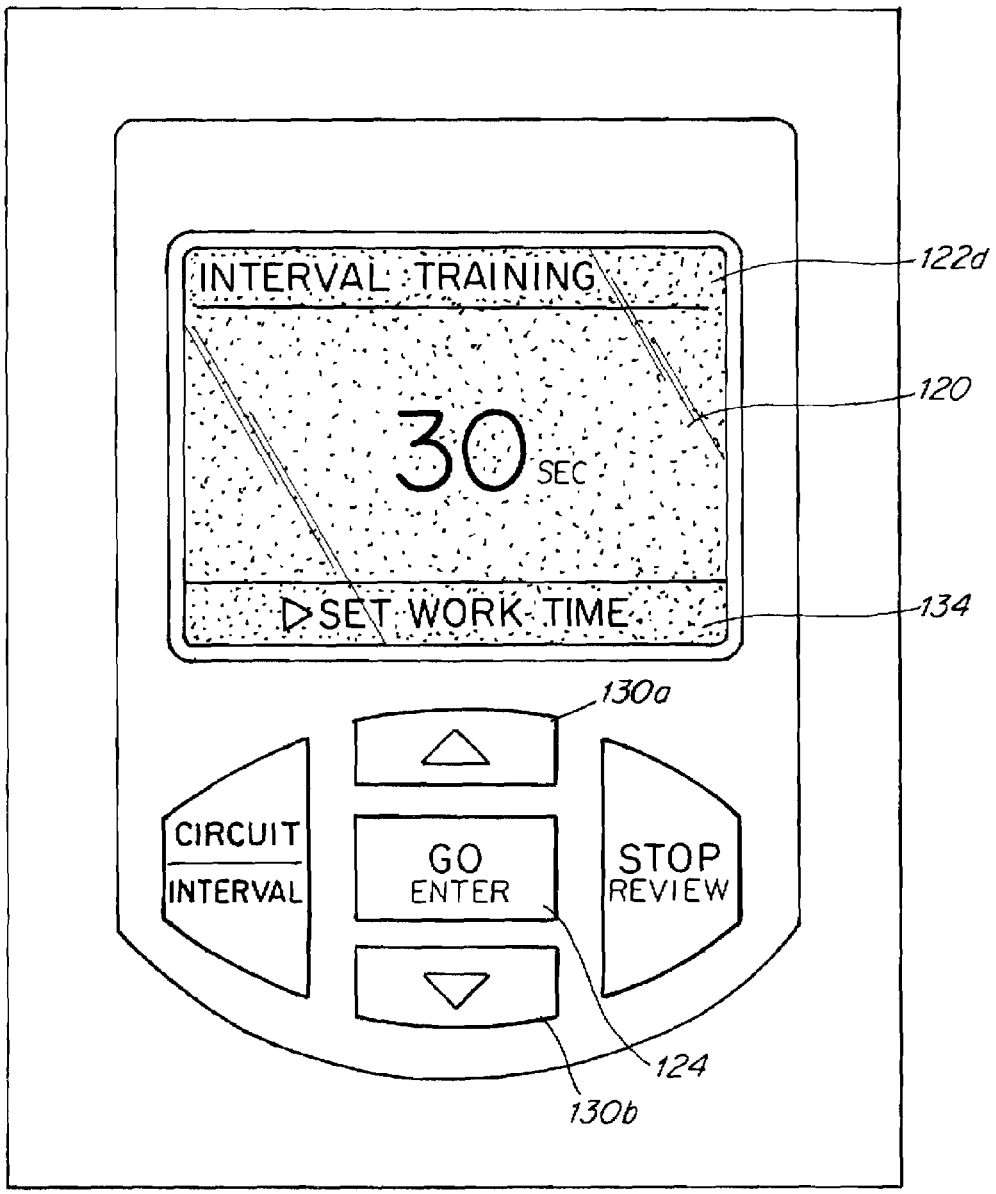
FIG. 17 is a view of the FIG. 14 interface showing an example of the appearance of the various displays appearing on the first of three input interfaces which are presented to the user prior to the beginning of an interval workout routine calling for the user to manually engage certain up, down and enter buttons to set a work or exercise time as part of the interval routine.

FIGS. 17-21 illustrate the interfaces and operation of an Interval (as opposed to Circuit) Training Mode. FIG. 17 depicts the first of three input interfaces, which are presented to the user prior to the beginning of the workout routine. Menu label 122*d* has changed to read "INTERVAL TRAINING", such that the user may easily ascertain the selected mode of operation at any given moment in time. Command prompt 134 reads "SET WORK TIME", informing the user that he or she is choosing the amount of exercise time that each interval should consist of. Primary display area 120 provides a display of the currently selected amount of work time, in seconds. Arrow keys 130*a* and 130*b* are used to increment or decrement the work time as desired. Once the work time is suitably adjusted, the user presses "Enter" button 124 and is taken to the second input interface screen, seen in FIG. 5.

Figure 18:
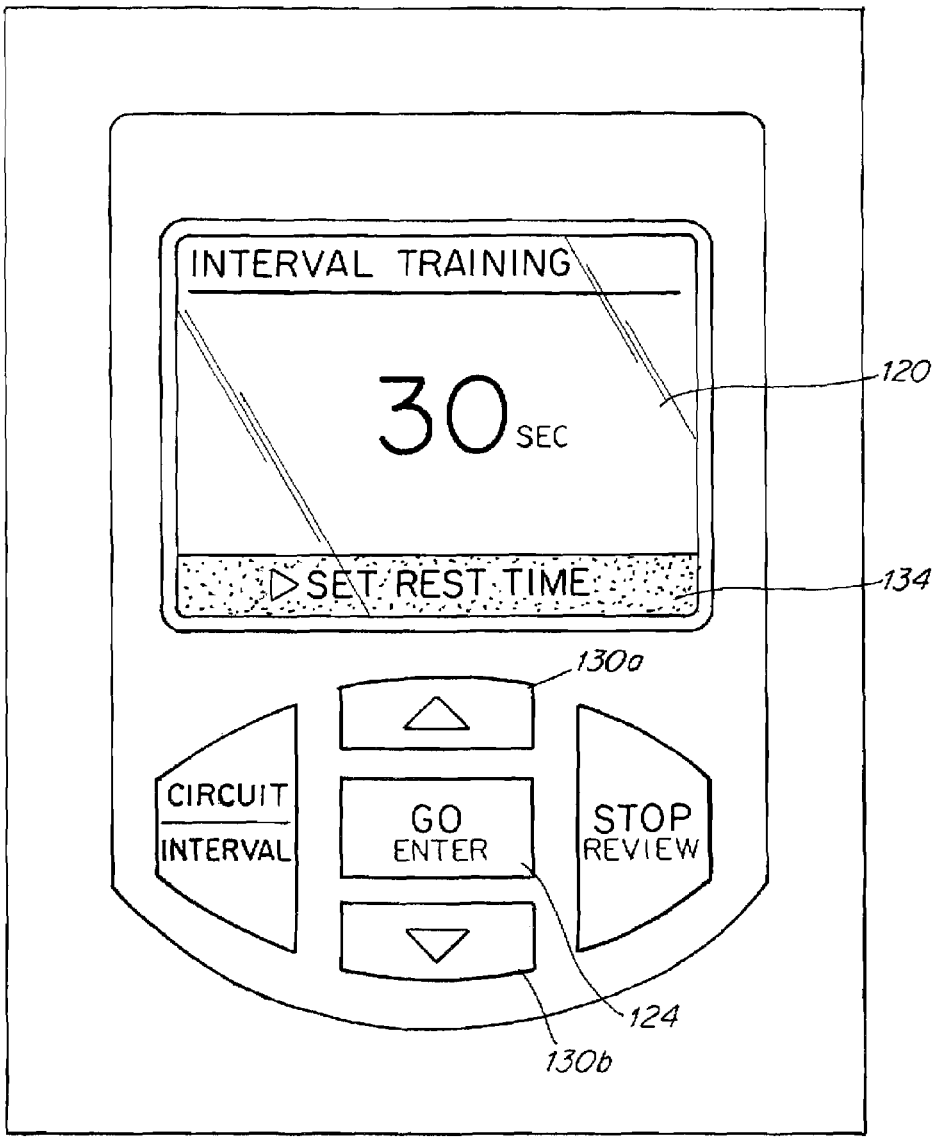
FIG. 18 is a view of the FIG. 14 interface showing an example of the appearance of the various displays appearing on the second of three input interfaces which are presented to a user prior to the beginning of an interval workout routine calling for the user to manually engage certain up, down and enter buttons to set a rest time as part of the interval routine.

Two changes distinguish FIGS. 17 and 18. FIG. 18 uses an inverted color scheme as compared to FIG. 17, and the command prompt 134 has updated to "SET REST TIME", in order to inform the user that he or she is choosing the amount of resting, non-exercise time that each interval should consist of. By utilizing an inverted color scheme, it becomes far easier for the user to distinguish between the two discrete input steps, as he or she would be more likely to fail to recognize the change if only command prompt 134 updated between the two input steps. The amount of time that the rest period shall consist of is set in a manner identical to the one described above. The amount of work time and rest time need not be equal. Once the rest time is suitably adjusted, the user presses "Enter" button 124 and is taken to the final input interface screen, seen in FIG. 19.

Figure 19:
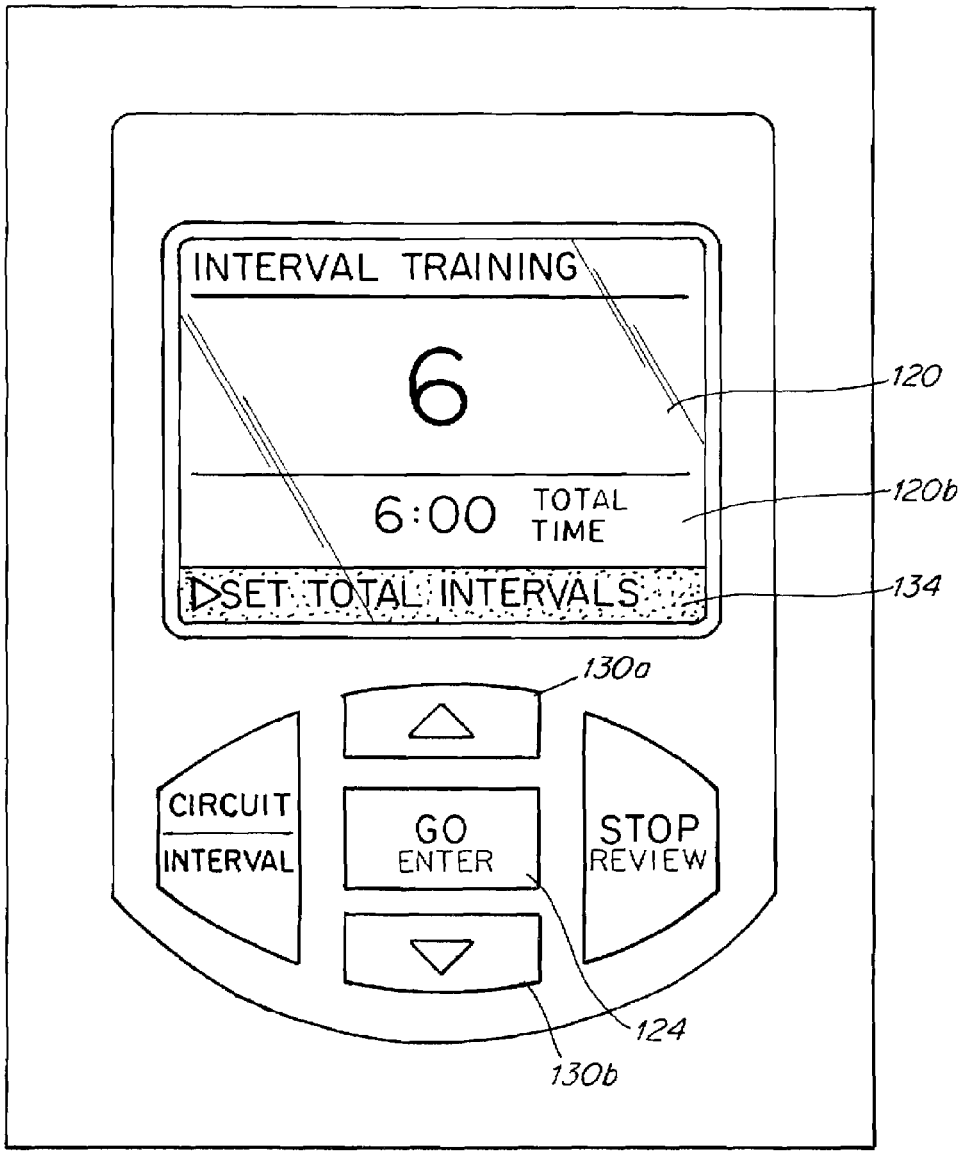
FIG. 19 is a view of the FIG. 14 interface showing an example of the appearance of the various displays appearing on the third of three input interfaces which are presented to a user prior to the beginning of an interval workout routine calling for the user to manually engage certain up, down and enter buttons to set a number of total intervals as part of the interval routine.

As between FIGS. 18 and 19, the color scheme inverts once again, continuing the process of aiding the user in recognizing requests for new information or inputs. Command prompt 134 has updated to "SET TOTAL INTERVALS", informing the user that he or she is choosing the number of intervals that the workout routine shall consist of. Note that one interval consists of a single work period followed immediately by a single rest period. As in the previous two input interfaces, primary display area 120 displays the adjustable, currently selected input value. As before, this value is incremented or decremented by arrow keys 130*a* and 130*b*. A smaller display area, 120*b*, is introduced in this interface, and provides the user with a convenient readout of how long the total workout routine will last, based on the prior inputs of work time and rest time and the current input of total intervals. This readout is re-calculated and adjusted concurrent with any adjustments that the user may make to the total number of intervals. After pressing "Go" button 124, the user now begins the interval workout routine.

Figure 20:
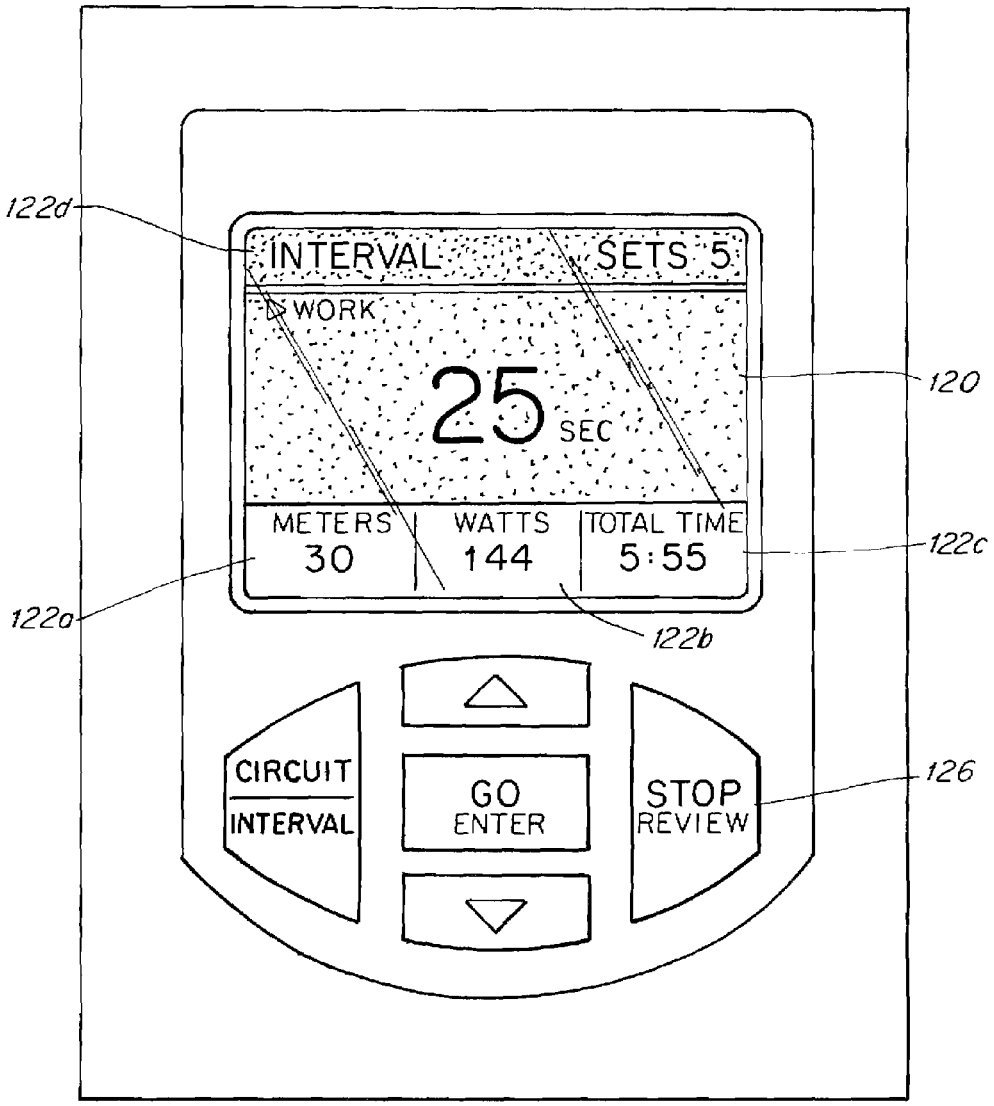
FIG. 20 is a view of the FIG. 14 interface showing an example of the appearance of the various displays presented while an interval training workout is ongoing after a user has input the control data shown in FIGS. 17-19.
Figure 21:
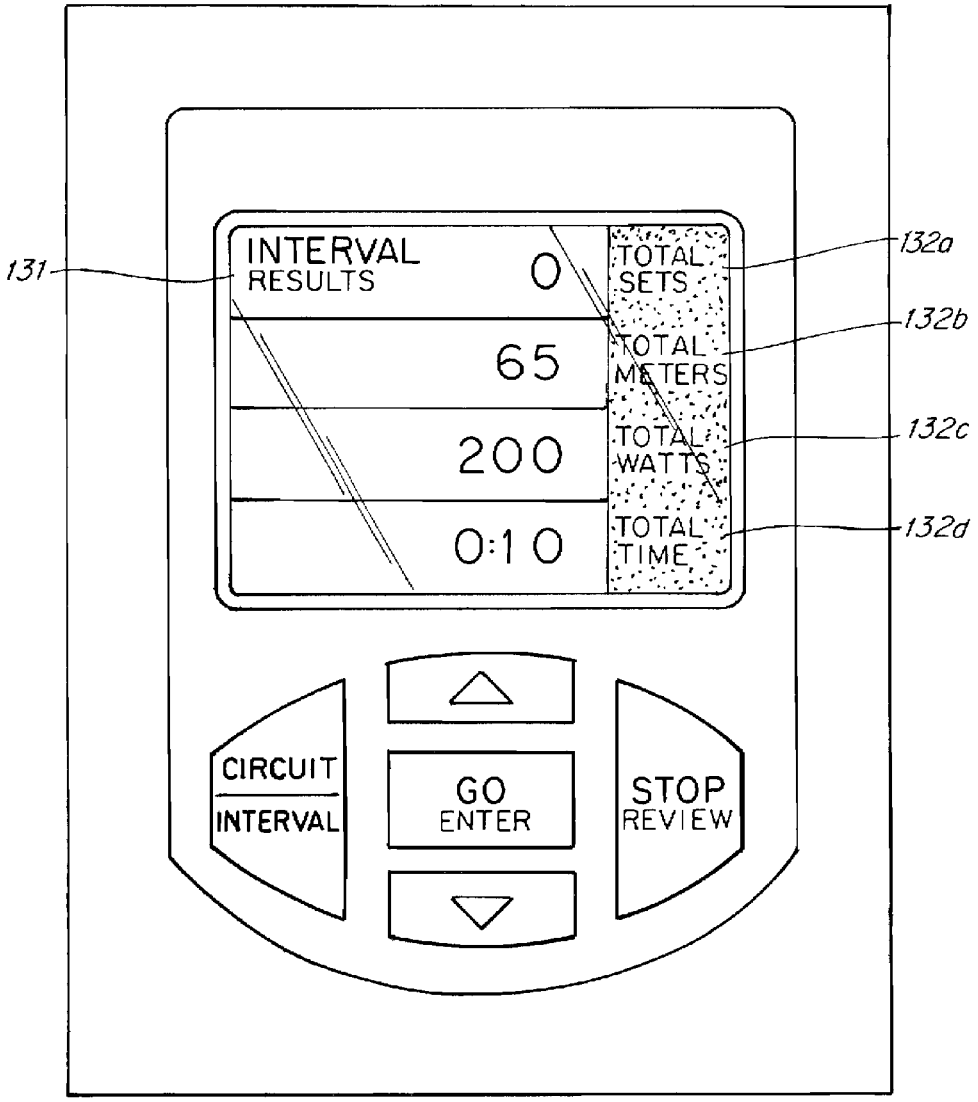
FIG. 21 is a view of the FIG. 14 interface showing an example of the appearance of the various displays presented either after a user actuates the STOP button after an interval routine has begun or after the number of user selected and input intervals of an interval routine have expired on their own showing the results of an interval routine.

FIG. 20 illustrates the interface presented while the interval training workout is ongoing. Note the similarity between said interface and the circuit training interface of FIGS. 1 and 2. While these two interface screens would never be seen one after another, the difference between the two screens is nevertheless emphasized by the use of contrasting color schemes. The bottom three display areas 122*a-c* are highly similar between the two different interface modes. 122*a* and 122*c* are identical to as described above, and 122*b* is identical to the Power measurement display described above, but relocated to a different zone of the display.

In Interval Training Mode, display label 122*d* has changed to read "INTERVAL SETS 5", such that the user may easily ascertain that he or she is currently in Interval Training Mode, and such that the user may furthermore keep track of the number of intervals, or sets, remaining. While the number five is seen in FIG. 20, note that this is solely for purposes of example, as in reality, the number seen on the display updates in real-time to indicate the number of intervals remaining in the workout routine. D Immediately after the workout routine is initiated by the user, the first interval begins, starting with the work/exercise portion. The user's current state, or position in the cycle of the interval, is indicated in the top left corner of primary display area 120, by a label reading either "WORK" or "REST". In both the work and rest steps, a large counter fills primary display area 120, beginning at the predetermined amount of time selected by the user via the process described above. The counter then decrements second by second, until it expires at zero.

When the counter expires at zero, the next step of work or rest commences, and this cycle of intervals continues until the user presses "Stop" button 126 or the input number of total intervals is completed in full. Once the workout routine is either terminated or expires on its own, the user is presented with the review interface of FIG. 21. Label 131 in the top left corner indicates at all times to the user that the mode of operation is and was set to Interval Training Mode, and furthermore, that the interface console is in the review interface. The review interface is designed to be simple and easy to understand, introducing no new measurements or other factors. It presents the user with just four values, all tabulated into accumulated form. Display area 132*a* presents the user with the total number of full sets performed over the duration of the workout routine, and 132*b* similarly presents the user with the total distance, in meters, executed by his or her foot path(s). Display area 132*c* is shown depicting the average power output of the user, in watts, while display area 132*d* presents the total amount of elapsed time spent performing the interval training routine.

What is claimed is:

1. An exercise apparatus comprising:

a foot support suspended from above by a suspension assembly on a frame, the foot support being movable by the user on the frame back and forth between a rearwardmost downward position and a forwardmost upward position through any one of a plurality of complete, reproducible and different arc segments of a master arcuate path that is the same path from the rearwardmost downward position to the forwardmost upward position and back to the rearwardmost downward position, each different arc segment being individually selectable by the user, each said different arc segment being defined by movement of the foot support between a corresponding different forwardmost upward position and different rearwardmost downward position, each of said different arc segments having a different degree of incline corresponding to each different forwardmost upward and rearwardmost downward position of the foot support, wherein movement of the foot support between the rearwardmost downward position and the forwardmost upward position and back to the rearwardmost downward position defines a complete exercise cycle, a resistance assembly interconnected to the foot support, the resistance assembly being adapted to exert a resistance to movement of the foot support by the user that varies non-linearly with the degree of speed, velocity, force, work or energy exerted by the user on the foot support or the resistance assembly, the foot support being adapted to support the user in an upright position with the user's foot disposed on the foot support, the foot support being interconnected to a selection device that enables the user to select any one of the plurality of arc segments, the selection device is manually actuatable by the user to exert a selectable amount of manual force on the selection device that operates to selectively position the resistance assembly in one of a plurality of predetermined fixed mechanical positions according to the selectable amount or degree of manual force exerted by the user on the selection device.

2. The apparatus of claim 1 wherein the resistance assembly comprises a fan interconnected to the foot support for rotation in response to back and forth movement of the foot support.

3. A method of performing an exercise by a user of the apparatus of claim 1 comprising the user's exerting a selected amount of manual force on the selection device to select one of the plurality of arc segments and the user's moving the foot support between the forwardmost upward and the rearwardmost downward positions.

4. An exercise apparatus comprising:

a foot support suspended from above by a suspension assembly on a frame, and interconnected to a resistance assembly that exerts a resistance to movement of the foot support by a user, the foot support being adapted to support the user in an upright position with the user's foot disposed on the foot support, a user interface that includes a visual display readily visually observable and manually accessible by the user when the user's foot is disposed on the foot support, the foot support being movable by the user on the frame back and forth between a rearwardmost downward position and a forwardmost upward position through any one of a plurality of complete, reproducible and different arc segments of a master arcuate path that is the same path from the rearwardmost downward position to the forwardmost upward position and back to the rearwardmost downward position, each different arc segment being individually selectable by the user, each said different arc segment being defined by movement of the foot support between a corresponding different forwardmost upward position and different rearwardmost downward position, each of said different arc segments having a different degree of incline corresponding to each different forwardmost upward and rearwardmost downward position of the foot support, wherein movement of the foot support between the rearwardmost downward position and the forwardmost upward position and back to the rearwardmost downward position defines a complete exercise cycle, the foot support being interconnected to a selection device that enables the user to select any one of the plurality of arc segments, one or more detectors adapted to detect one or more of force, energy or power exerted by the user over time on the foot support or to detect distance or velocity of travel of the foot support or of the resistance assembly during the course of the user's performance of all or a portion of an exercise cycle, the one or more detectors sending signals that are indicative of one or more of the detected force, energy, power, time, distance or velocity to a processor, the processor receiving the signals from the one or more detectors and processing the signals according to a predetermined algorithm to generate a visually recognizable output format of one or more of said force, energy, power, time, distance, velocity or other result calculable from said signals, the processor being interconnected to and sending the processed signals to the visual display, the visual display being arranged and displaying the processed signals to the user in the visually recognizable output format in a location on the apparatus that is readily observable by the user, wherein the processor includes control instructions that instruct the processor to send converted signals to the visual display during a preselected interval of exercise time and to stop receiving signals from the detector or to stop sending the converted signals to the visual display on expiration of the preselected interval of exercise time, the user interface including an interval button interconnected to the processor that is manually actuatable by the user to input and send a signal to the processor that is indicative of the preselected interval of exercise time, wherein the control instructions include instructions that define a preselected interval of rest time immediately subsequent to the preselected interval of exercise time, wherein during said preselected interval of the rest time the processor does not receive signals from the detector or does not send the converted signals to the visual display, the control instructions further including instructions that instruct the processor to repeat the preselected interval of exercise time and the preselected interval of rest time a preselected number of times following expiration of a first preselected interval of exercise time and a first preselected interval of rest time.

5. The apparatus of claim 4 wherein the foot support and the resistance assembly are interconnected by the selection device, the selection device being operable by the user to selectively position the resistance assembly in any one of a plurality of predetermined fixed mechanical positions that respectively correspond to a selectable one of the plurality of arc segments.

6. The apparatus of claim 5 wherein the selection device is manually actuatable by the user to exert a selectable amount of manual force on the selection device that operates to selectively position the resistance assembly in a one of the plurality of predetermined fixed mechanical positions according to the selectable amount of manual force exerted by the user on the selection device.

7. The apparatus of claim 4 wherein the resistance assembly exerts a degree of resistance that increases non-linearly with the degree of increase of speed, velocity, force, energy or rate of travel exerted by the user on the foot support or resistance assembly.

8. The apparatus of claim 7 wherein the resistance assembly exerts a degree of resistance that increases exponentially with the degree of increase of force, energy or velocity of travel exerted by the user on the foot support.

9. The apparatus of claim 7 wherein the resistance assembly comprises a rotatable fan or blade adapted to rotate in response to movement of the foot support such ambient air impinges on and resists rotation of the fan or blade.

10. The apparatus of claim 4 wherein the user interface includes a start button manually actuatable by the user to initiate detection of movement of the foot support by the at least one detector upon manual actuation of the start button by the user.

11. The apparatus of claim 10 wherein the user interface includes a stop button manually actuatable by the user to stop detection of movement of the foot support by the at least one detector upon manual actuation of the stop button by the user.

12. The apparatus of claim 4 wherein the processor includes control instructions that instruct the processor to send converted signals to the visual display during a preselected interval of exercise time and to stop receiving signals from the detector or to stop sending the converted signals to the visual display on expiration of the preselected interval of exercise time, the user interface including an interval button interconnected to the processor that is manually actuatable by the user to input and send a signal to the processor that is indicative of the preselected interval of exercise time.

13. The apparatus of claim 12 wherein the control instructions include instructions that define a preselected interval of rest time immediately subsequent to the preselected interval of exercise time, wherein during said preselected interval of the rest time the processor does not receive signals from the detector or does not send the converted signals to the visual display, the control instructions further including instructions that instruct the processor to repeat the preselected interval of exercise time and the preselected interval of rest time a preselected number of times following expiration of a first preselected interval of exercise time and a first preselected interval of rest time.

14. A method of performing multiple different exercises in time sequential manner by an exerciser, the method comprising:

the exerciser's selecting at least first and second different exercise regimes that require exercise of different muscle groups, the exerciser's performing and completing a selected one of the first or second exercise regimes, substantially immediately after the step of performing and completing the selected one of the first or second exercise regimes, the exerciser's performing and completing the other of the first or second exercise regimes, wherein the first exercise regime comprises performing an exercise by the exerciser using an apparatus according to claim 4.

15. A method of performing an exercise by a user of the apparatus of claim 6 comprising the user's exerting a selected amount of manual force on the selection device to select one of the plurality of arc segments and the user's moving the foot support between the forwardmost upward and the rearwardmost downward positions.

16. An exercise apparatus comprising:

a foot support suspended from above by a suspension assembly on a frame, and interconnected to a resistance assembly that exerts a resistance to movement of the foot support by a user, the foot support being adapted to support the user in an upright position with the user's foot disposed on the foot support, a user interface that includes a visual display readily visually observable and manually accessible by the user when the user's foot is disposed on the foot support, the foot support being movable by the user on the frame back and forth between a rearwardmost downward position and a forwardmost upward position through any one of a plurality of complete, reproducible and different arc segments of a master arcuate path that is the same path from the rearwardmost downward position to the forwardmost upward position and back to the rearwardmost downward position, each different arc segment being individually selectable by the user, the selection device is manually actuatable by the user to enable the user to exert a selectable amount of manual force on the selection device that operates to selectively position the resistance assembly in one of a plurality of predetermined fixed mechanical positions according to the selectable amount or degree of manual force exerted by the user on the selection device which in turn operates to selectively limit travel of the foot pedal to a selectable one of the plurality of arc segments according to the selectable amount of manual force exerted by the user on the selection device, each said different arc segment being defined by movement of the foot support between a corresponding different forwardmost upward position and different rearwardmost downward position, each of said different arc segments having a different degree of incline corresponding to each different forwardmost upward and rearwardmost downward position of the foot support, wherein movement of the foot support between the rearwardmost downward position and the forwardmost upward position and back to the rearwardmost downward position defines a complete exercise cycle, one or more detectors adapted to detect one or more of force, energy or power exerted by the user over time on the foot support or to detect distance or velocity of travel of the foot support or of the resistance assembly during the course of the user's performance of all or a portion of an exercise cycle, the one or more detectors sending signals that are indicative of one or more of the detected force, energy, power, time, distance or velocity to a processor, the processor receiving the signals from the one or more detectors and processing the signals according to a predetermined algorithm to generate a visually recognizable output format of one or more of said force, energy, power, time, distance, velocity or other result calculable from said signals, the processor being interconnected to and sending the processed signals to the visual display, the visual display being arranged and displaying the processed signals to the user in the visually recognizable output format in a location on the apparatus that is readily observable by the user.

17. The apparatus of claim 16 wherein the foot support and the resistance assembly are interconnected by the selection device, the selection device being operable by the user to selectively position the resistance assembly in any one of a plurality of predetermined fixed mechanical positions that respectively correspond to a selectable one of the plurality of arc segments.

18. A method of performing multiple different exercises in time sequential manner by an exerciser, the method comprising:

the exerciser's selecting at least first and second different exercise regimes that require exercise of different muscle groups, the exerciser's performing and completing a selected one of the first or second exercise regimes, substantially immediately after the step of performing and completing the selected one of the first or second exercise regimes, the exerciser's performing and completing the other of the first or second exercise regimes, wherein the first exercise regime comprises performing an exercise by the exerciser using an apparatus according to claim 16.

19. A method of performing an exercise by a user of the apparatus of claim 16 comprising the user's exerting a selected amount of manual force on the selection device to select one of the plurality of arc segments and the user's moving the foot support between the forwardmost upward and the rearwardmost downward positions.

20. An exercise apparatus comprising:

a foot support suspended from above by a suspension assembly on a frame, and interconnected to a resistance assembly that exerts a resistance to movement of the foot support by a user, the foot support being adapted to support the user in an upright position with the user's foot disposed on the foot support, a user interface that includes a visual display readily visually observable and manually accessible by the user when the user's foot is disposed on the foot support, the foot support being movable by the user on the frame back and forth between a rearwardmost downward position and a forwardmost upward position through any one of a plurality of complete, reproducible and different arc segments of a master arcuate path that is the same path from the rearwardmost downward position to the forwardmost upward position and back to the rearwardmost downward position, each different arc segment being individually selectable by the user, wherein the selection device is manually actuatable by the user to enable the user to exert a selectable amount of manual force on the selection device that operates to selectively limit travel of the foot pedal to a selectable one of the plurality of arc segments according to the selectable amount of manual force exerted by the user on the selection device, each said different arc segment being defined by movement of the foot support between a corresponding different forwardmost upward position and different rearwardmost downward position, each of said different arc segments having a different degree of incline corresponding to each different forwardmost upward and rearwardmost downward position of the foot support, wherein movement of the foot support between a rearwardmost downward position and a forwardmost upward position and back to the rearwardmost downward position defines a complete exercise cycle, the foot support being interconnected to a selection device that enables the user to select any one of the plurality of arc segments, one or more detectors adapted to detect one or more of force, energy or power exerted by the user over time on the foot support or to detect distance or velocity of travel of the foot support or of the resistance assembly during the course of the user's performance of all or a portion of an exercise cycle, the one or more detectors sending signals that are indicative of one or more of the detected force, energy, power, time, distance or velocity to a processor the processor receiving the signals from the one or more detectors and processing the signals according to a predetermined algorithm to generate a visually recognizable output format of one or more of said force, energy, power, time, distance, velocity or other result calculable from said signals, the resistance assembly comprising a fan, the algorithm including instructions that receive and process an environment value indicative of at least one of air temperature and air pressure, the environment value being used by the instructions as a variable to generate the visually recognizable output format of said force, energy, power, time, distance, velocity or other result calculable from said signals, the processor being interconnected to and sending the processed signals to the visual display, the visual display being arranged and displaying the processed signals to the user in the visually recognizable output format in a location on the apparatus that is readily observable by the user, wherein the processor includes control instructions that instruct the processor to send converted signals to the visual display during a preselected interval of exercise time and to stop receiving signals from the detector or to stop sending the converted signals to the visual display on expiration of the preselected interval of exercise time, the user interface including an interval button interconnected to the processor that is manually actuatable by the user to input and send a signal to the processor that is indicative of the preselected interval of exercise time.

21. A method of performing multiple different exercises in time sequential manner by an exerciser, the method comprising:

the exerciser's selecting at least first and second different exercise regimes that require exercise of different muscle groups, the exerciser's performing and completing a selected one of the first or second exercise regimes, substantially immediately after the step of performing and completing the selected one of the first or second exercise regimes, the exerciser's performing and completing the other of the first or second exercise regimes, wherein the first exercise regime comprises performing an exercise by the exerciser using an apparatus according to claim 20.

22. A method of performing an exercise by a user of the apparatus of claim 20 comprising the user's exerting a selected amount of manual force on the selection device to select one of the plurality of arc segments and the user's moving the foot support between the forwardmost upward and the rearwardmost downward positions.

* * * * *